US010526099B2

(12) United States Patent
Bison

(10) Patent No.: US 10,526,099 B2
(45) Date of Patent: Jan. 7, 2020

(54) PALLET ROPING AND WRAPPING APPARATUS

(71) Applicant: Darrel Bison, Phoenix, AZ (US)

(72) Inventor: Darrel Bison, Phoenix, AZ (US)

( * ) Notice: Subject to any disclaimer, the term of this patent is extended or adjusted under 35 U.S.C. 154(b) by 197 days.

(21) Appl. No.: 15/799,835

(22) Filed: Oct. 31, 2017

(65) Prior Publication Data

US 2018/0208339 A1 Jul. 26, 2018

Related U.S. Application Data

(63) Continuation of application No. 14/265,179, filed on Apr. 29, 2014, now Pat. No. 9,802,722, which is a continuation-in-part of application No. 13/287,038, filed on Nov. 1, 2011, now Pat. No. 8,707,664, which is a continuation of application No. 12/551,167, filed on Aug. 31, 2009, now Pat. No. 8,046,975, which is a continuation of application No. 11/668,954, filed on Jan. 30, 2007, now Pat. No. 7,581,368.

(60) Provisional application No. 60/829,339, filed on Oct. 13, 2006, provisional application No. 60/829,085, filed on Oct. 11, 2006.

(51) Int. Cl.

| | |
|---|---|
| ***B65B 11/58*** | (2006.01) |
| ***B65B 11/00*** | (2006.01) |
| ***B65B 11/04*** | (2006.01) |

(52) U.S. Cl.

CPC ..... *B65B 11/585* (2013.01); *B65B 11/006* (2013.01); *B65B 11/045* (2013.01)

(58) Field of Classification Search

CPC ..... B65B 11/585; B65B 11/58

USPC ..... 53/170, 203, 210, 218

See application file for complete search history.

(56) References Cited

U.S. PATENT DOCUMENTS

| | | | |
|---|---|---|---|
| 1,351,809 | A | 9/1920 | Sutherland |
| 2,026,282 | A | 12/1935 | Leguillon |
| 2,823,530 | A | 2/1958 | Rikard |
| 3,793,798 | A | 2/1974 | Lancaster |
| 3,896,604 | A | 7/1975 | Marantz |
| 4,102,513 | A | 7/1978 | Guard |
| 4,166,589 | A | 9/1979 | Hoover et al. |
| 4,235,062 | A | 11/1980 | Lancaster et al. |
| 4,255,918 | A | 3/1981 | Lancaster et al. |
| 4,353,515 | A | 10/1982 | Weaver et al. |
| 4,468,922 | A | 9/1984 | McCrady et al. |
| 4,530,473 | A | 7/1985 | Parry |

(Continued)

FOREIGN PATENT DOCUMENTS

| | | | |
|---|---|---|---|
| DE | 3933952 | C1 | 5/1990 |
| EP | 0178145 | A1 | 4/1986 |

(Continued)

*Primary Examiner* — Gloria R Weeks

(74) *Attorney, Agent, or Firm* — Booth Udall Fuller, PLC

(57) ABSTRACT

Pallet roping and wrapping machines having a plurality of spools of stretch film supported on one or more spools and guides that form ropes of stretch film without cutting. Specific implementations of guides include guides formed or rings and rollers. Positions of guides may be adjustable. A primary roll of stretch film may be positionally coupled to a primary spool core, and a plurality of secondary rolls of stretch film may be positionally coupled to one or more secondary spool cores. The wrapping machines may include a plurality of guides positioned to narrow the stretch film from the plurality of secondary rolls to form a plurality of ropes fully overlapping a web of the primary roll of stretch film when wrapped around a palletized load.

14 Claims, 17 Drawing Sheets

(56) References Cited

U.S. PATENT DOCUMENTS

| | | | |
|---|---|---|---|
| 4,619,102 | A | 10/1986 | Geisinger |
| 4,671,043 | A | 6/1987 | Forni |
| 4,723,393 | A | 2/1988 | Silbernagel |
| 4,739,945 | A | 4/1988 | Yokoe |
| 4,807,427 | A | 2/1989 | Casteel et al. |
| 4,845,920 | A | 7/1989 | Lancaster |
| 4,905,448 | A | 3/1990 | Plitt |
| 4,905,451 | A | 3/1990 | Jaconelli |
| 4,961,306 | A | 10/1990 | Sawhney et al. |
| 5,031,771 | A | 7/1991 | Lancaster |
| 5,079,898 | A | 1/1992 | Springs et al. |
| 5,107,657 | A | 4/1992 | Diehl et al. |
| 5,125,209 | A | 6/1992 | Thimon et al. |
| 5,168,685 | A | 12/1992 | Suzuki |
| 5,195,297 | A | 3/1993 | Lancaster et al. |
| 5,203,939 | A | 4/1993 | Sperling et al. |
| 5,211,353 | A | 5/1993 | Lewin |
| 5,307,609 | A | 5/1994 | Kurata |
| 5,315,808 | A | 5/1994 | MacIvor et al. |
| 5,385,001 | A | 1/1995 | Ramer |
| 5,409,177 | A | 4/1995 | Parry |
| 5,447,009 | A | 9/1995 | Oleksy et al. |
| 5,535,962 | A | 7/1996 | Bargowski |
| 5,797,246 | A | 8/1998 | Martin-Cocher |
| 5,819,503 | A | 10/1998 | Lancaster, III |
| 5,965,262 | A | 10/1999 | Whisler et al. |
| 6,065,269 | A | 5/2000 | Malnati |
| 6,164,047 | A | 12/2000 | Rossi |
| 6,311,459 | B1 | 11/2001 | Rossi |
| 6,393,808 | B1 | 5/2002 | Kallner |
| 6,688,076 | B1 | 2/2004 | Rivera, Jr. |
| 6,745,544 | B2 | 6/2004 | Matsumoto et al. |
| 6,775,956 | B1 | 8/2004 | Lacey |
| 6,796,105 | B2 | 9/2004 | Rossi |
| 6,892,515 | B2 | 5/2005 | Cere' |
| 6,971,220 | B1 | 12/2005 | Rampp |
| 7,269,935 | B2 | 9/2007 | Jafari |
| 7,581,368 | B1 | 9/2009 | Bison |
| 7,621,107 | B2 | 11/2009 | Vanderheiden |
| 7,908,831 | B1 | 3/2011 | Dugan |
| 8,046,975 | B1 | 11/2011 | Bison |
| 8,053,056 | B2 | 11/2011 | Heikaus et al. |
| 8,276,349 | B2 | 10/2012 | Van Amstel et al. |
| 8,528,615 | B2 | 9/2013 | Colson |
| 8,549,819 | B1 | 10/2013 | Bison |
| 8,707,664 | B1 | 4/2014 | Bison |
| 2008/0066431 | A1 | 3/2008 | Cousins |
| 2008/0092489 | A1 | 4/2008 | Smith |
| 2008/0209859 | A1 | 9/2008 | Vanderheiden |
| 2009/0277136 | A1 | 11/2009 | Van Amstel |
| 2011/0088359 | A1 | 4/2011 | Brocard |

FOREIGN PATENT DOCUMENTS

| | | | |
|---|---|---|---|
| EP | 1332968 | A1 | 8/2003 |
| EP | 1803345 | A1 | 7/2007 |
| GB | 2241484 | A | 4/1991 |
| JP | 10129609 | A | 5/1999 |
| JP | 2000302102 | A | 10/2000 |
| JP | 2002166905 | A | 6/2002 |
| JP | 2002211502 | A | 7/2002 |
| JP | 2002225806 | A | 8/2002 |
| JP | 2002225807 | A | 8/2002 |
| WO | 9012737 | A1 | 11/1990 |
| WO | 2009155713 | A2 | 12/2009 |

PALLET ROPING AND WRAPPING APPARATUS

CROSS-REFERENCE TO RELATED APPLICATIONS

This application is a divisional of U.S. patent application entitled PALLET ROPING AND WRAPPING APPARATUS, Ser. No. 14/265,179, filed Apr. 29, 2014, issuing as U.S. Pat. No. 9,802,722 on Oct. 31, 2017, which is a continuation-in-part of U.S. patent application entitled PALLET ROPING AND WRAPPING APPARATUS, Ser. No. 13/287,038, filed Nov. 1, 2011, issuing as U.S. Pat. No. 8,707,664 on Apr. 29, 2014, which is a continuation-in-part of U.S. patent application entitled PALLET ROPING AND WRAPPING APPARATUS, Ser. No. 12/551,167, filed Aug. 31, 2009, which is now U.S. Pat. No. 8,046,975, which is a continuation of U.S. Utility patent application entitled PALLET ROPING AND WRAPPING APPARATUS Ser. No. 11/668,954 which was filed on Jan. 30, 2007, and is now U.S. Pat. No. 7,581,368, which claims the benefit of the filing date of U.S. Provisional Patent Application No. 60/829,339, entitled HAND ROPER, which was filed on Oct. 13, 2006, and of the filing date of U.S. Provisional Patent Application No. 60/829,085, entitled RAPIDROPER, which was filed on Oct. 11, 2006, the contents of each of which are each hereby incorporated herein by reference.

BACKGROUND

Technical Field

Aspects of this document relate generally to securing and protecting palletized loads.

Background Art

Goods to be transported in containers on, for example, ships, trucks, trains or the like frequently are packed on pallets. Such palletized goods or material, further, may be wrapped in stretch film in order to protect the material from damage caused by, for example, shifting on a pallet or being bumped by goods on adjacent pallets.

Material such as furniture or boxed goods may be completely wrapped in contiguously overlapping stretch film, effectively sealing wrapped material from contact with air or from contact with other material, which may be, for example, on other pallets. However, other types of material, such as, for example, fresh fruits and vegetables, require that air be allowed to circulate among the palletized material in order to prevent buildup of condensation or to aid in cooling or warming the material. One known method for packing these kinds of goods includes wrapping the palletized material in netting, or with a rope rather than in stretch film.

SUMMARY

According to a first aspect of particular embodiments and implementations disclosed an apparatus for securing a palletized load comprises a primary roll of stretch film, at least two secondary rolls of stretch film, and at least two sets of guides. The primary roll of stretch film is supported by a first spool support member. The at least two secondary rolls of stretch film are supported by a second spool support member. The at least two sets of guides each comprise a guide width less than a width of each of the at least two secondary rolls, each of the guides being positioned to receive a different one of the at least two secondary rolls through the respective guide, narrow the respective secondary roll to form a rope, and position the rope such that the rope fully overlaps a web formed by the primary roll as the primary roll and the at least two secondary rolls are wrapped around a palletized load.

Various implementations and embodiments may comprise one or more of the following. A first set of the at least two sets of guides may be positioned to receive a first secondary roll of the at least two secondary rolls, narrow the first secondary roll to form a first rope, and position the first rope between a central portion of the web and a first edge of the web as the primary roll and the at least two secondary rolls are wrapped around the palletized load. A second set of the at least two sets of guides may be positioned to receive a second secondary roll of the at least two second rolls, narrow the secondary roll to form a second rope, and position the second rope between the central portion of the web and a second edge of the web as the primary roll and the at least two secondary rolls are wrapped around the palletized load. The at least two secondary rolls of stretch film may comprise at least three secondary rolls of stretch film and the at least two sets of guides may comprise at least three sets of guides, a third set of guides of the at least three sets of guides being positioned between the first and second sets of guides to receive a third secondary roll of the at least three secondary rolls, narrow the third secondary roll to form a third rope, and position the third rope approximately central between the first and second edges of the web as the primary roll and the at least three secondary rolls are wrapped around the palletized load. The at least two secondary rolls of stretch film may comprise at least four secondary rolls of stretch film. The at least two sets of guides may comprise at least four sets of guides. A third set of guides of the at least four sets of guides may be positioned between the first and second sets of guides to receive a third secondary roll of the at least four secondary rolls, narrow the third secondary roll to form a third rope, and position the third rope between the first and second edges of the web as the primary roll and the at least four secondary rolls are wrapped around the palletized load. A fourth set of guides of the at least four sets of guides may be positioned between the first and second sets of guides to receive a fourth secondary roll of the at least four secondary rolls, narrow the fourth secondary roll to form a fourth rope, and position the fourth rope between the first and second edges of the web as the primary roll and the at least four secondary rolls are wrapped around the palletized load such that each the four ropes are spaced substantially equal distance from the adjacent rope of the four ropes. The at least two secondary rolls of stretch film may be positionally coupled to a common core such that the at least two secondary rolls unroll at substantially the same rate. The at least two second rolls of stretch film may each be coupled to a different core of at least two cores, the at least two cores being coupled together such that the at least two secondary rolls unroll at substantially the same rate. A perforating spindle may be positioned to perforate the primary roll of stretch film and the at least two secondary rolls of stretch film as the primary roll and the at least two second rolls are wrapped around the palletized load. The at least two secondary rolls may be colored differently than the primary roll.

According to another aspect, a method of inhibiting tearing of stretch film wrapped around a palletized load comprises dispensing a primary roll of stretch film supported on a first support member; dispensing at substantially the same rate at least two secondary rolls of stretch film supported by a second support member; narrowing a width of each of the at least two secondary rolls with at least two sets of guides to form at least two ropes; positioning, with the at least two sets of guides, the at least two ropes to fully overlap the primary roll; and simultaneously applying the primary roll and the at least two ropes to a palletized load such that the at least two ropes fully overlap a web formed by the application of the primary roll around the palletized load.

Various implementations and embodiments may comprise one or more of the following. Positioning, with the at least two sets of guides, the at least two ropes to fully overlap the primary roll may comprise positioning, with a first set of guides of the least two sets of guides, a first rope of the least two ropes between a central portion of the web and a first edge of the primary roll; and positioning, with a second set of guides of the at least two sets of guides, a second rope of the least two ropes between the central portion and a second edge of the primary roll. The at least two sets of guides may comprise at least three sets of guides, the at least two secondary rolls may comprise at least three secondary rolls, and the at least two ropes may comprise at least three ropes, and the method may further comprise positioning, with a third set of guides of the at least three sets of guides, a third rope of the at least three ropes approximately central between the first edge and the second edge of the primary roll. The at least two sets of guides may comprise at least four sets of guides, the at least two secondary rolls may comprise at least four secondary rolls, and the at least two ropes may comprise at least four ropes, and the method may further comprise positioning, with a third set of guides of the at least four sets of guides, a third rope of the at least four ropes between the first edge and the second edge of the primary roll; and positioning, with a fourth set of guides of the at least four sets of guides, a fourth rope of the at least four ropes between the first edge and the second edge of the primary roll such that each rope of the at least four ropes is equal distance from the adjacent rope of the four ropes. Simultaneously pre-stretching the primary roll and the at least two secondary rolls of stretch film while overlapped prior to applying the primary roll and the at least two second rolls of stretch films to the palletized load. Perforating the primary roll of stretch film and the at least two secondary rolls of stretch film before applying the primary roll and the at least two secondary rolls of stretch film to the palletized load.

According to another aspect, a tamper deterring apparatus for securing a palletized load comprises a primary roll of stretch film, at least one secondary roll of stretch film, and at least one set of guides. The primary roll of stretch film supported by a first spool support member. The at least one secondary roll of stretch film is colored differently than the primary roll of stretch film and supported by a second spool support member. The at least one set of guides comprises a guide width less than a width of the at least one secondary roll and is positioned to receive the at least one secondary roll through the guide, narrow the at least one secondary roll to form a rope, and position the rope such that the rope fully overlaps a web formed by the primary roll as the primary roll and the secondary roll are wrapped around a palletized load.

Various implementations and embodiments may comprise one or more of the following. The at least one secondary roll may comprise at least two secondary rolls colored differently than the primary roll of stretch film and supported by a second spool support member, the at least one set of guides may comprise at least two sets of guides each comprising a guide width less than a width of each of the at least two secondary rolls, each of the guides may be positioned to receive a different one of the at least two secondary rolls through the respective guide, narrow the respective secondary roll to form a rope, and position the rope such that the rope fully overlaps the web formed by the primary roll as the primary roll and the second roll are wrapped around the palletized load. A first set of the at least two sets of guides may be positioned to receive a first secondary roll of the at least two secondary rolls, narrow the first secondary roll to form a first rope, and position the first rope between a central portion of the web and a first edge of the web as the primary roll and the at least two secondary rolls are wrapped around the palletized load. A second set of the at least two sets of guides may be positioned to receive a second secondary roll of the at least two second rolls, narrow the secondary roll to form a second rope, and position the second rope between a central portion of the web and a second edge of the web as the primary roll and the at least two secondary rolls are wrapped around the palletized load. The at least two secondary rolls of stretch film may comprise at least three secondary rolls of stretch film colored differently than the primary roll and the at least two sets of guides may comprise at least three sets of guides, a third set of guides of the at least three sets of guides being positioned between the first and second sets of guides to receive a third secondary roll of the at least three secondary rolls, narrow the third secondary roll to form a third rope, and position the third rope approximately central between the first and second edges of the web as the primary roll and the at least three secondary rolls are wrapped around the palletized load. The at least two secondary rolls of stretch film may comprise at least four secondary rolls of stretch film colored differently than the primary roll of stretch film. The at least two sets of guides may comprise at least four sets of guides. A third set of guides of the at least four sets of guides may be positioned between the first and second sets of guides to receive a third secondary roll of the at least four secondary rolls, narrow the third secondary roll to form a third rope, and position the third rope between the first and second edges of the web as the primary roll and the at least four secondary rolls are wrapped around the palletized load. A fourth set of guides of the at least four sets of guides may be positioned between the first and second sets of guides to receive a fourth secondary roll of the at least four secondary rolls, narrow the fourth secondary roll to form a fourth rope, and position the fourth rope between the first and second edges of the web as the primary roll and the at least four secondary rolls are wrapped around the palletized load such that each the four ropes are spaced substantially equal distance from the adjacent rope of the four ropes.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Various aspects of implementations of pallet wrapping and roping machines will hereinafter be described in conjunction with the appended drawings, where like designations denote like elements, and.

DESCRIPTION

This disclosure, its aspects and implementations, are not limited to the specific devices and methods disclosed herein. Many additional elements, components, and procedures known in the art consistent with the intended use of the apparatus and methods described will become apparent for use with various implementations of pallet-wrapping apparatus and techniques from this disclosure. Accordingly, for example, although a particular apparatus may be disclosed, such apparatus may comprise any shape, size, style, type, model, version, material, and/or the like as is known in the art for such apparatus, consistent with the intended operation of the devices described herein.

Figure 1:
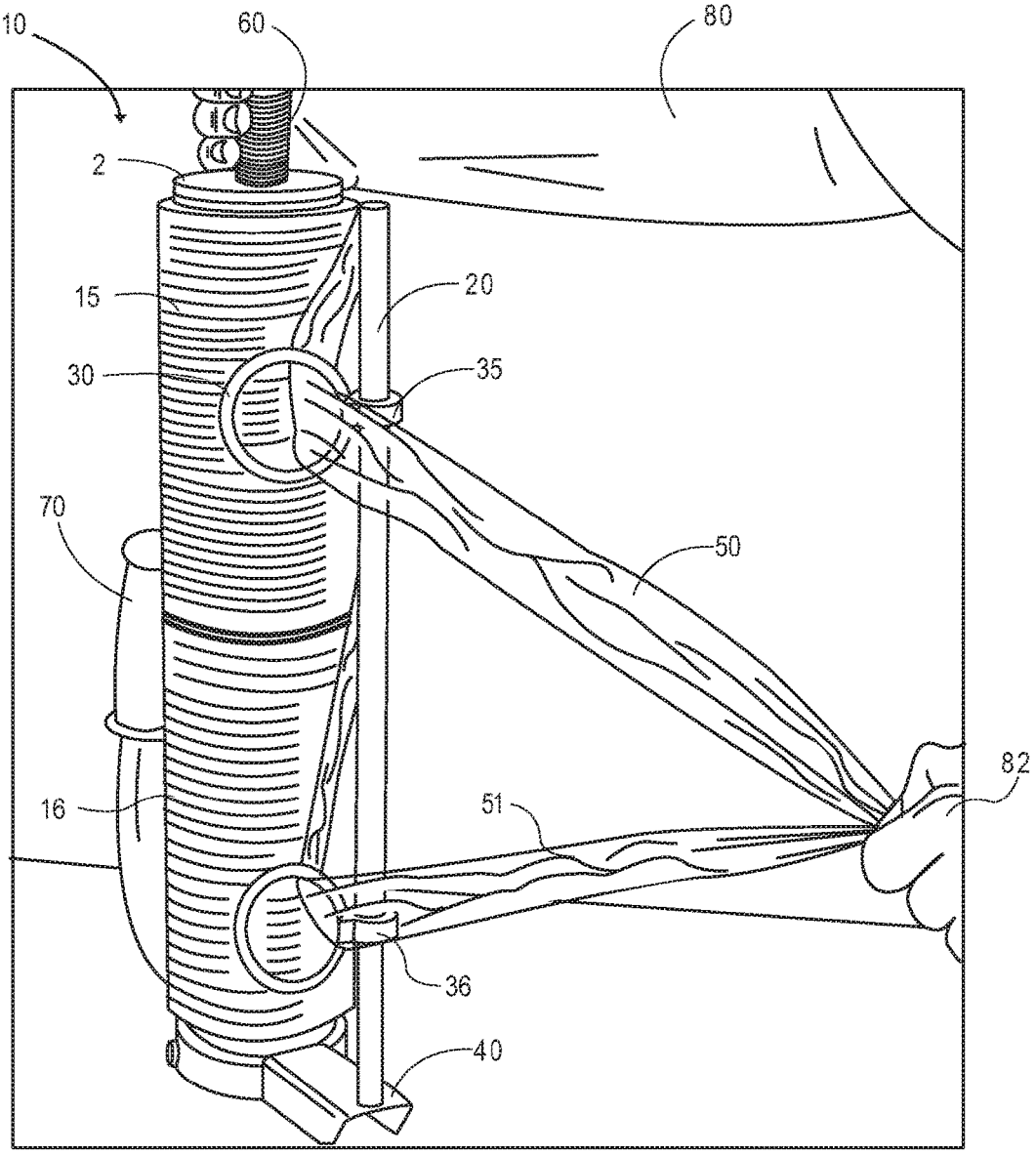
FIG. 1 is a pictorial diagram of a particular implementation of an apparatus for wrapping palletized loads.

A particular implementation of a pallet roping and wrapping apparatus 10, which may be employed for securing a palletized load, is shown in FIG. 1. The apparatus 10 comprises a first roll 15 and a second roll 16 of stretch film and a single spool 2 configured to support the first and second rolls 15 and 16 of stretch film. The first and second rolls 15 and 16 may be positioned essentially contiguously on the spool 2. The apparatus 10 further may comprise a baseplate 40 and a spool support member (which may be a rod, not shown) adapted to support the spool 2, the spool support member having an end affixed to and supported by the baseplate 40. The spool 2 may have an axis that typically coincides with a center axis shared by the first and second rolls 15 and 16 of stretch film. The illustrated implementation still further comprises a pair of guides, first guide 30 and second guide 31, and a guide support member 20, which may comprise, for example, a rod. The guide support member 20 may have an end coupled to and supported by the baseplate 40. That is, the spool support member and the guide support member 20 may share mechanical support provided by the baseplate 40. The guide support member 20 may have an axis oriented to be substantially parallel to the axis of the spool 2 in normal operation. In the illustrated implementation of FIG. 1, the first and second guides 30 and 31 are formed as rings. First guide 30 is secured to the guide support member 20 by a first collar 35 that may be adjustably positioned on the guide support member 20 at a location nominally opposite a midpoint of the first roll 15. Likewise, second guide 31, which also may have an adjustable position according to a location of a second collar 36, may be located nominally opposite a midpoint of the second roll 16. The illustrated positions of first and second guides 30 and 31 are only examples, as positions of the first and second guides 30 and 31 may be adjusted in either a ganged fashion or independently according to needs or preferences of a user of the apparatus 10.

Stretch film from first and second rolls 15 and 16 may be threaded or otherwise passed through first and second guides 30 and 31 to form a first rope 50 and a second rope 51 of stretch film. It should be noted that in the industry a "rope" is also sometimes called a "band." It should also be noted that there is no need to cut or otherwise modify, distort, or weaken the stretch film coming from the roll. Any such cutting, modifying, or distorting is obviated by the use of separate first and second rolls 15 and 16 of stretch film. Indeed, known devices that require cutting of stretch film or that employ cutting or distorting of stretch film in their operation may cause inconvenience and expense to users of the known devices as a result of consequential breaking and/or tearing of the stretch film.

It should be understood that the present disclosure contemplates using a plurality of rolls of stretch film and that first and second rolls 15 and 16 in the particular implementation illustrated in FIG. 1 are not intended to be limiting. Likewise, particular implementations of apparatus for securing palletized loads may comprise a plurality of guides (e.g., first and second guides 30 and 31, or more) being adjustably secured to a guide support member 20 by a plurality of collars (e.g., first and second collars 35 and 36). An implementation comprising such a plurality of rolls and guides may be employed to form a plurality of ropes (e.g., first and second ropes 50 and 51, or more) of stretch film with which to wrap or otherwise secure a palletized load.

Adjustment of positions of the guides (e.g., first and second guides 30 and 31) may be accomplished in one exemplary implementation using set screws (not shown) employed in the collars in a conventional manner. Adjustable clamps may replace the collars in other implementations without departing from any intention of the present disclosure.

Figure 2:
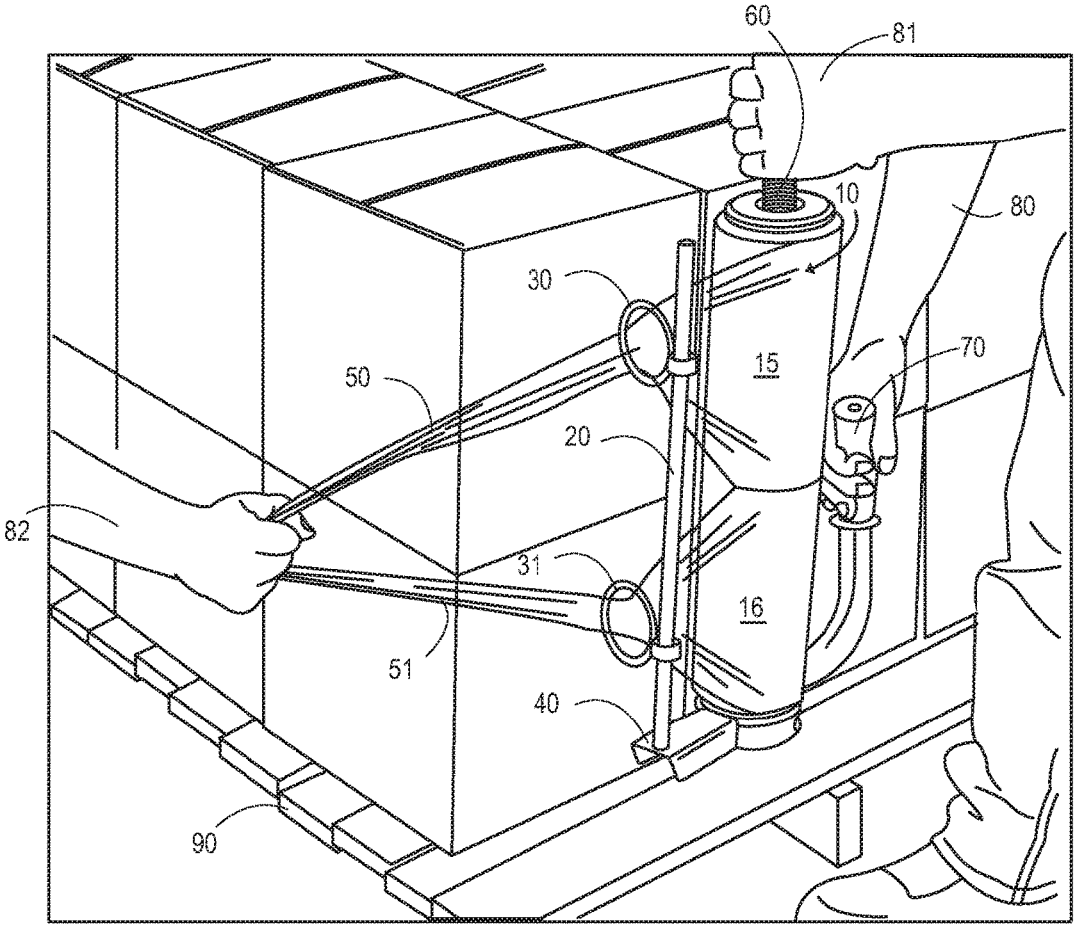
FIG. 2 is a pictorial diagram of the particular implementation of FIG. 1 illustrating hand-held use of the apparatus.

An axial handle 60 may be coupled to an end of the spool support member, the axial handle having an axis nominally aligned with the center axis shared by the spool support member and the first and second rolls 15 and 16 of stretch film. A side handle 70, further, may be affixed to the baseplate 40. A first user supporting the apparatus would hold both the axial handle 60 and the side handle 70. Arm 80 and hand 81 (See FIGS. 1 and 2) are from the user supporting the apparatus. A second user may draw the first and second ropes 50 and 51 using hand 82. The side handle 70 and the axial handle 60 may be employed by a user to support the particular apparatus 10 as illustrated in FIG. 2. Alternative or differently configured handles may be used. As is further illustrated in FIG. 2, the side handle 70 and the axial handle 60 may be employed by a user move the apparatus 10 around a palletized load in order to extend first and second ropes 50 and 51, thereby wrapping and/or securing the palletized load.

For example, a first user may support the apparatus 10 by using a hand on a first arm 80 to grasp the side handle 70 and a second hand 81 to grasp the axial handle 60. First and second ropes 50 and 51 may be grasped by a hand 82 of a second user to hold ends of the first and second ropes 50 and 51 while the first user circumnavigates (e.g., walks around) a palletized load situated on a nominally stationary pallet 90, thereby wrapping and securing the palletized load. In another particular implementation described more particularly with reference to FIG. 6, a pallet wrapping device remains stationary while a palletized load is rotated in order to accomplish wrapping of ropes of stretch film around the load.

Figure 3A:
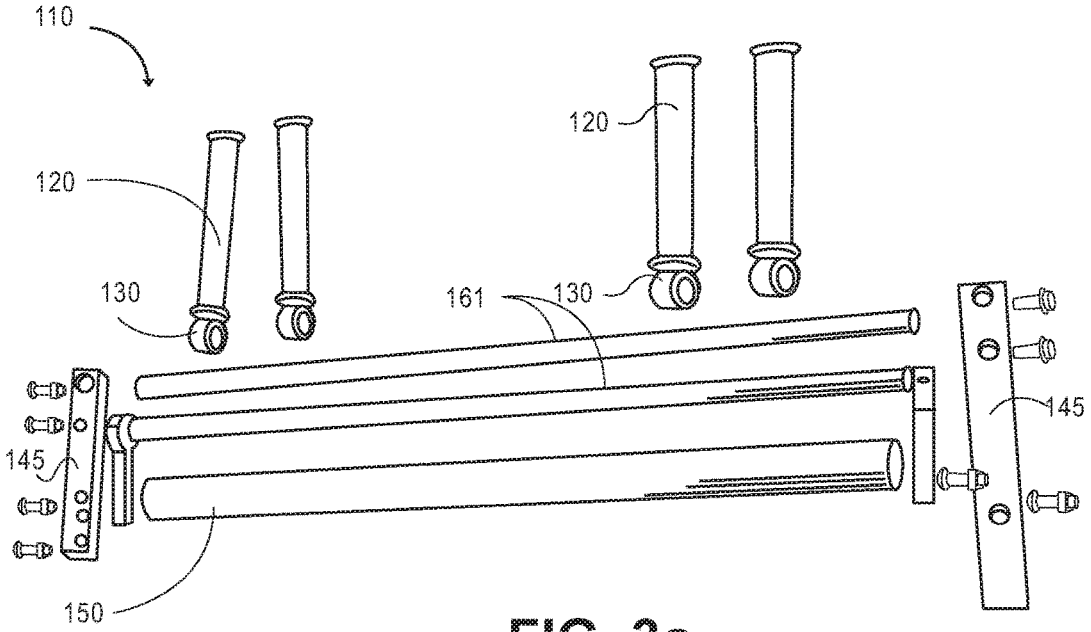
FIG. 3*a* is a disassembled view of a subassembly of another particular implementation of a palletized load-wrapping apparatus.
Figure 3B:
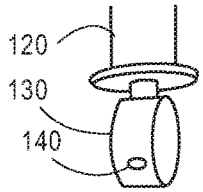
FIG. 3*b* is a close-up view of a portion of FIG. 3*a;*

FIG. 3*a* is a disassembled view of a subassembly 110 of a particular implementation of a stretch wrap machine 170 (FIG. 5), which may function as a palletized load wrapping apparatus. Elements of this subassembly 110 of the stretch wrap machine 170 include a plurality of rollers 120 (four are shown in FIG. 3*a*), which may be used to form guides that may perform a function similar to first and second guides 30 and 31 introduced in FIGS. 1 and 2. The rollers 120 may have affixed thereto collars 130 that may slidably and adjustably fit over a rod 161 having first and second ends, the rod 161 being adapted to function as a supporting member for the plurality of rollers 120. The collars 130 may include set screws 140 suitable for facilitating adjustment of positions of the plurality of rollers 120 along the rod 161. The illustrated subassembly 110 further comprises a pair of brackets 145 adapted to provide mechanical support for the first and second ends of the rod 161. FIG. 3*b* is a close-up view of the collars 130, rollers 120 and set screws 140.

Figure 4:
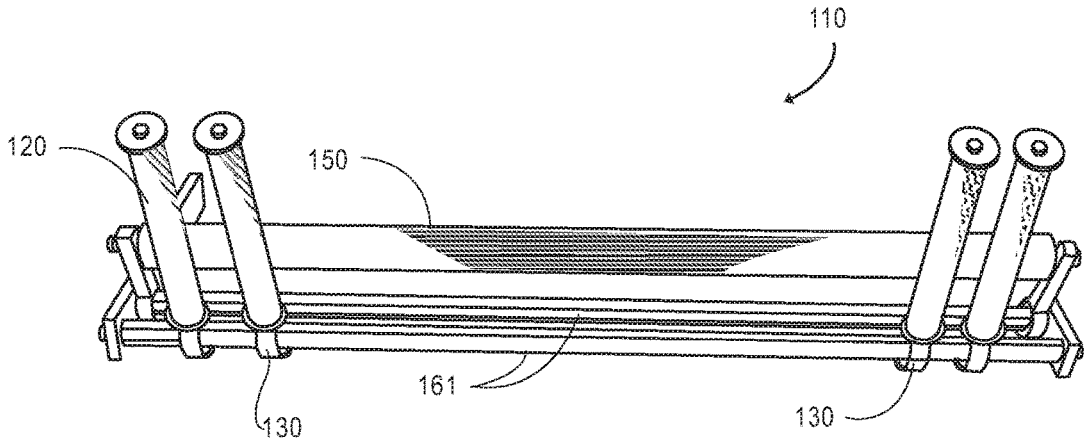
FIG. 4 is a view of the subassembly of FIG. 3*a* when assembled.

FIG. 4 is a partially-assembled subassembly 110 of FIG. 3*a* illustrating the plurality of rollers 120 affixed to the supporting member or rod 161 by collars 130. The partially-assembled subassembly 110 further includes a wrap machine roller 150 having ends mechanically secured by the pair of brackets 145 that also secure ends of the rod 161 in a manner well-understood by one skilled in the art.

Figure 5:
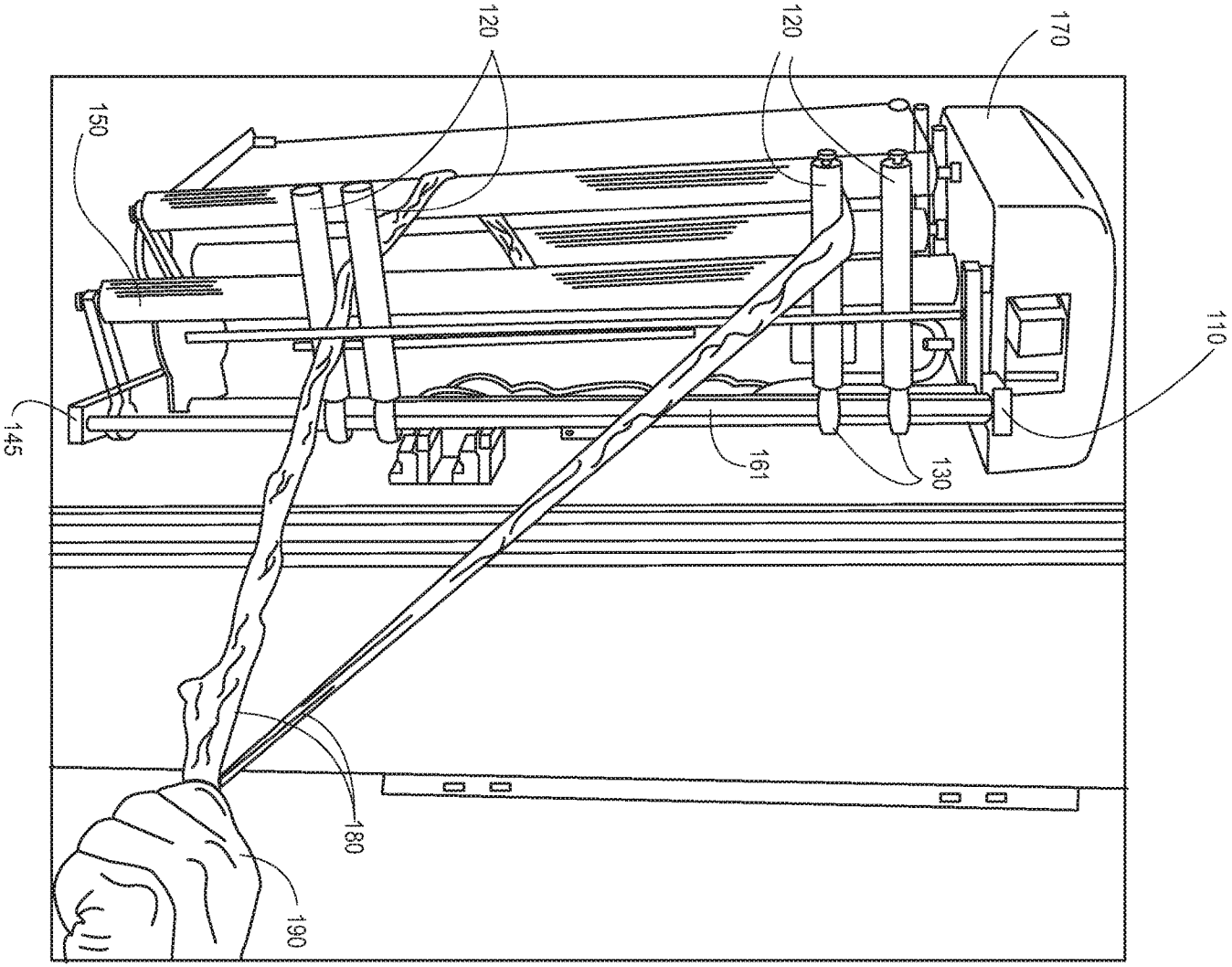
FIG. 5 is a pictorial diagram of a stretch wrap machine that includes a particular implementation of a rope-forming apparatus.

FIG. 5 is a pictorial diagram of a stretch wrap machine 170 that includes the subassembly 110 described above with reference to FIGS. 3 and 4. The stretch wrap machine 170, which may be employed as a palletized load-wrapping apparatus, may be configured for applications suited to wrapping palletized loads that arrive at the stretch wrap machine 170 on, for example, a conveyer belt, front loader or other transport medium. Typical implementations of the stretch wrap machine 170 include a rotating platform (not shown) on which may be placed a palletized load ready for wrapping. A driving mechanism (not shown) may cause the platform to rotate while a remainder of the stretch wrap machine 170 remains essentially stationary relative to the palletized load intended to be secured by the stretch wrap machine 170. It is understood that "stationary" in the present context means that the palletized load may be free to rotate, but that the load does not undergo translational motion once it arrives at the stretch wrap machine 170 until after any wrapping procedure is completed.

The implementation of the stretch wrap machine 170 illustrated in FIG. 5 comprises the subassembly 110 described in greater detail with reference to FIGS. 3 and 4. The illustrated implementation further comprises elements not shown in FIG. 5, but that may be similar to those illustrated in another implementation 270 of a stretch wrap machine shown in FIG. 6. These elements may include a spool 202, and a plurality of rolls of stretch film, e.g., first roll 215 and second roll 216 disposed essentially adjacently on the spool 202.

Returning to FIG. 5, stretch film may be passed between pairs of rollers 120, which may function as guides, thereby forming ropes 180 of stretch film. Although two pairs of rollers 120 and two ropes 180 are illustrated in FIG. 5, the description applies as well to a plurality of pairs of rollers, which may facilitate forming of a corresponding plurality of ropes of stretch film. As the palletized load rotates and a starting point for the plurality of ropes of stretch film is established on the palletized load, the palletized load may become wrapped with the plurality of ropes of stretch film.

Figure 6:
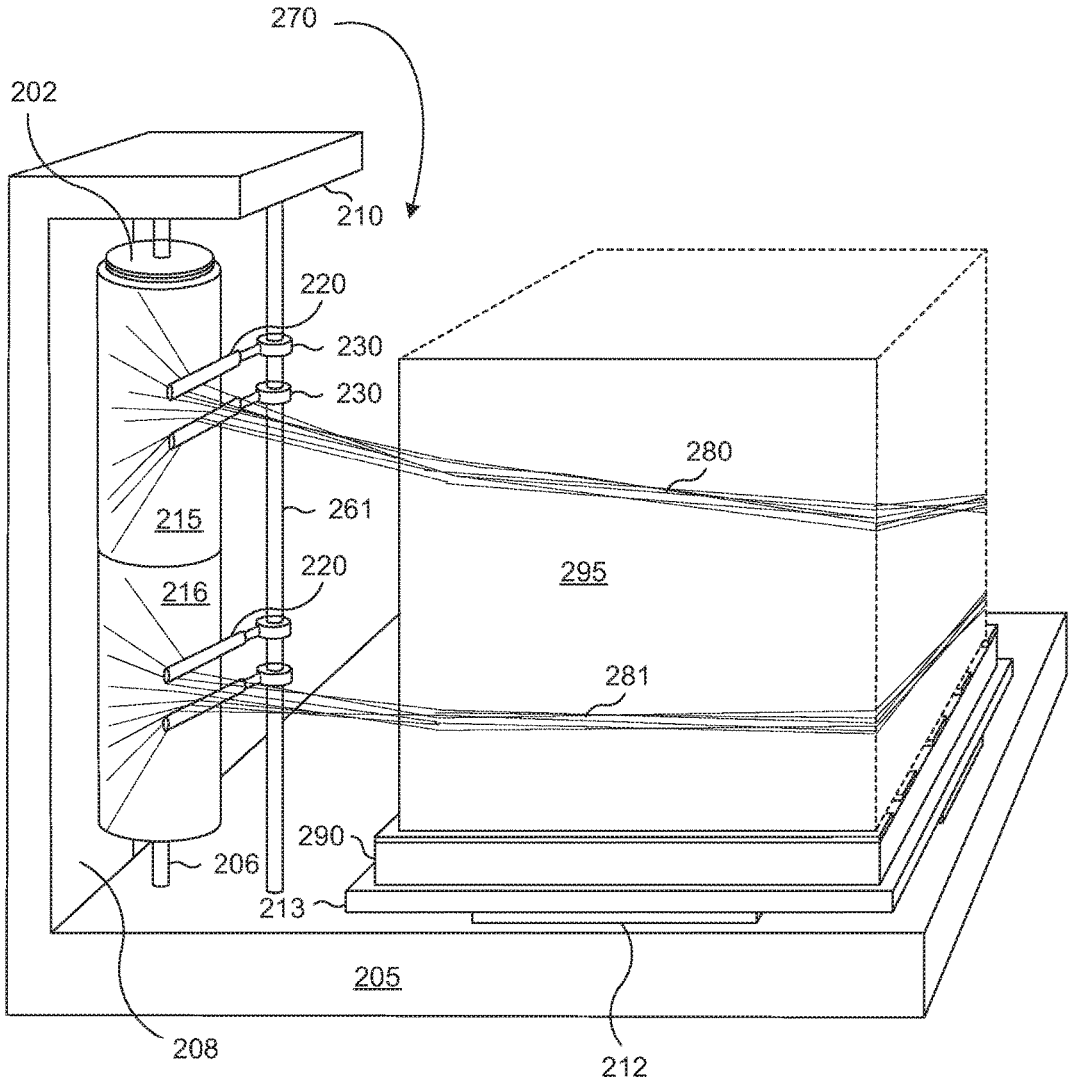
FIG. 6 is a pictorial diagram of a stretch wrap machine.

FIG. 6 is a pictorial diagram of a stationary stretch wrap machine 270 that may include elements described with reference to FIG. 5. The illustrated implementation comprises a spool 202 mounted on a spool support member 206, which is coupled at a first end on a platform 205 and supported on a second end by a bracket 210 that is essentially rigidly connected with the platform 205 by a connecting member 208. The spool 202 has disposed (e.g., wound) thereon first and second rolls 215 and 216 of stretch film, axes of the first and second rolls 215 and 216 essentially coinciding with an axis of the spool 202. Typically, first and second rolls 215 and 216 are disposed next to each other on the spool. The first and second rolls 215 and 216 may be disposed directly on the spool or disposed on separate spools that are then disposed on a common spool or roller (e.g. a common core with two spools around it and coupled to it) with the purpose that the first and second rolls necessarily unroll at substantially the same rate. If the first and second rolls 215 and 216 do not spin at substantially the same rate, as is necessitated by being on the same spool 202 or being otherwise equivalently forced to spin at substantially the same rate, the operation is less effective.

A guide support member 261, which is supported at a first end by the platform 205 and at a second end by the bracket 210, may be disposed nominally parallel to and at a convenient distance from the spool 202. That is, guide support member 261 may have an axis that is parallel to the axis of the spool 202. A plurality of rollers 220, which may be arranged in pairs to form guides, two of which are illustrated, for example, in FIG. 6, are adjustably connected with the guide support member 261 by a plurality of collars 230. The collars 230 may be configured so that positions of the plurality of rollers 220 may be adjusted.

Stretch film from the first and second rolls 215 and 216 pass through a pair of guides (formed by pairs of rollers 220 in the implementation shown in FIG. 6), forming first and second ropes 280 and 281 of stretch film. This disclosure, further, contemplates using two or more rolls, i.e., a plurality of rolls of stretch film in order to form a plurality of ropes of stretch film, by passing the stretch film through a plurality of guides although only two rolls, guides and ropes are illustrated in FIG. 6.

The platform 205 may have disposed thereon a support 212 that supports a rotatable platform 213 on which may be placed a pallet 290 of palletized goods 295 shown in dotted outline in FIG. 6 to reflect an arbitrary nature of an arrangement of the palletized goods 295. In operation, the pallet 290 and the palletized goods 295 may arrive at the stretch wrap machine 270 and may be placed onto the rotatable platform 213. First and second ropes 280 and 281 of stretch film may be formed as described herein and attached at initial ends (not illustrated) to the palletized load 295 in a known manner. The rotatable platform 213 then may be rotated (using, for example, a known type of motor and shaft arrangement not shown in FIG. 6), thereby pulling stretch film through the guides and extending first and second ropes 280 and 281 to wrap the palletized goods 295 as already described. It may be well to point out that although the stretch wrap machine 270 includes a rotating platform 213, portions of the stretch wrap machine 270 that form the stretch ropes 280 and 281 (i.e. the palletized load-securing apparatus) are fixed relative to the palletized load 295 being secured and relative to the rotatable platform 213.

Referring now to FIGS. 13-16, in some implementations the stretch wrap machine may comprise a plurality of spool cores and a plurality of rolls of stretch film, at least one on each of the spool cores. In these and other implementations, the plurality of spool cores may be coupled to one another with a coupling clip in such a manner that each of the plurality of spool cores and each of the plurality of rolls of stretch film all simultaneously rotate at the same rate as the plurality of rolls are unwound. Particular manners of coupling the plurality of spool cores to one another described herein are example implementations and do not encompass each and every implementation contemplated. For example, while each of FIGS. 13-16 illustrate two spool cores and two rolls of stretch film, other implementations may comprise any number of a plurality of spool cores coupled together and any number of rolls of stretch film. Furthermore, in some implementations, any number of rolls of stretch film may be associated with a single spool core.

Positionally coupling the plurality of rolls of stretch film to the plurality of spool cores, and coupling the plurality of spool cores to one another results in a uniform rotation rate of each of the plurality of spool cores and plurality of rolls about an axis. This uniform rotation rate assists in maintaining a uniform tautness of the plurality of stretch film wraps as the palletized load is wrapped. Studies have shown that maintenance of a taut stretch film wrap as the palletized load is wrapped results in a more effectively wrapped and secured palletized load, resists undesired stretch wrap tearing during the wrapping process, and allows much less stretch wrap to be used.

In various implementations, the plurality of coupling devices may either be removably or permanently coupled to one another. As illustrated herein, some implementations utilize a clip to couple the spool cores together. The clip(s) may be integral to the first and/or second spool core, or may be a separate clip. In some implementations, the plurality of spool cores may be further or alternatively be coupled to a separate core to assist with uniform rotation. In such an implementation, the core would then rotate at the same rate as the plurality of spool cores and the plurality of rolls.

Figure 13:
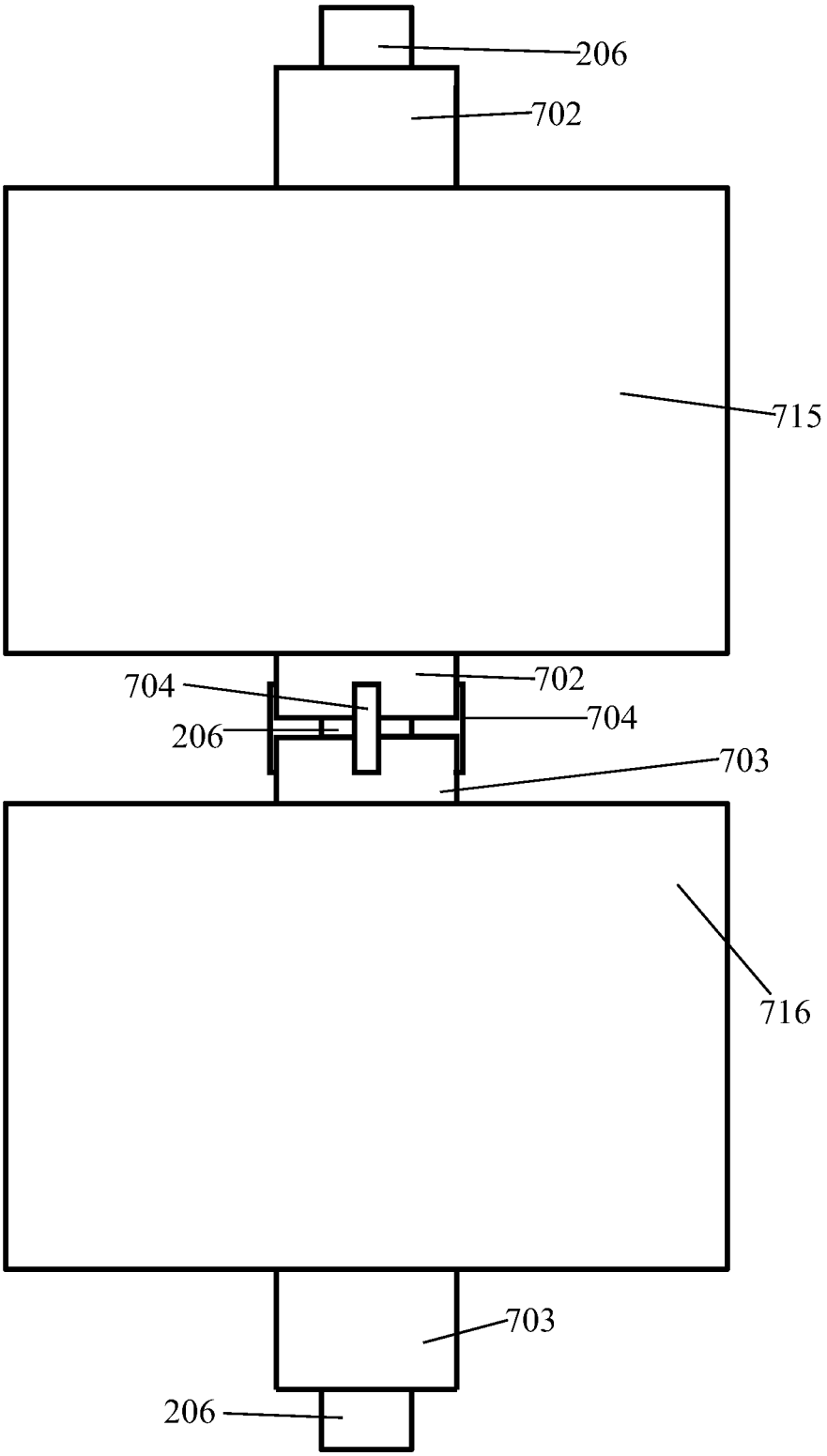
FIG. 13 is a front view of an implementation comprising two spool cores coupled together with coupling clips.

Referring specifically to FIG. 13, a first spool core 702 coupled to a second spool core 703 and supported by a support member 206 is illustrated. In the implementation of FIG. 13, the first spool core 702 is coupled to the second spool core with a plurality of coupling clips 704. The coupling clips 704 may be comprised of any variety of materials, such as but not limited to plastics, metals, rubbers, and the like. Furthermore, the coupling clips 704 may comprise any size or dimension. In the implementation illustrated in FIG. 13, there is a space between the first spool core 702 and the second spool core 703, and an even larger space between the first roll 715 and the second roll 716, though this is not required. In other implementations, the first spool core 702 and the second spool core 703 may abut one another. Likewise, in some implementations the first roll 715 and the second roll 716 may nearly abut one another or form a nearly contiguous surface. In some implementations, only a single coupling clip 704 may couple the first spool core 702 and the second spool 703 together. In other implementations, any number of coupling clip 704 may couple the first 702 and second 703 spool cores together. The coupling clip in this and other embodiments and implementations described hereafter causes the first roll 715 and the second roll 716 to rotate at the same rate about the support member as if they were one a single, contiguous core.

The coupling clip 704 may comprise a protrusion, nub, or at least one pyramid like point near each end of the coupling clip on a surface that faces the plurality of spool cores 702, 703. The plurality of spool cores 702, 703 may further comprise holes or depressions to mate with the protrusion, nub, or pyramid of the coupling clip 704. In other implementations, the pyramid like points may be pressed into the surface of the spool core 702, 703, thus attaching the coupling clip 704 to the spool core. In still other implementations, the coupling clip 704 or the plurality of spool 702, 703 cores may comprise an adhesive that adheres the coupling clip 704 to the spool core 702, 703. The coupling clips 704 may, in other implementations, comprise any type of mechanism or compound for coupling the clip 704 to the spool core 702, 703.

Figure 14:
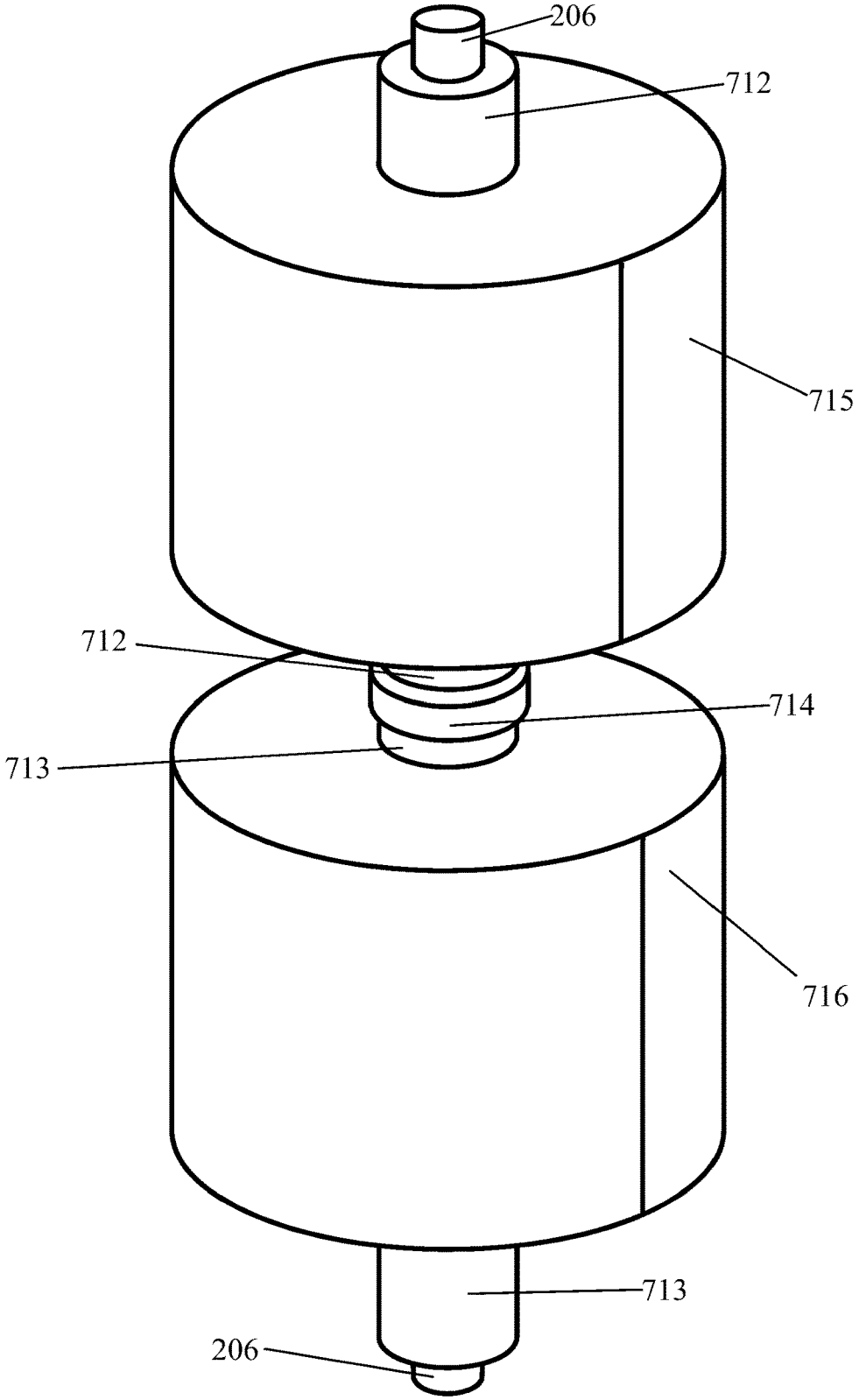
FIG. 14 is a perspective view of an implementation comprising two spool cores coupled together with a ring-shaped coupling clip.

Referring specifically to FIG. 14, another implementation comprising a first spool core 712 coupled to a second spool core 713 is illustrated. In the implementation of FIG. 14, the first spool core 712 and the second spool core 713 are coupled together with a coupling clip 714 in the form of a coupling ring 714. The coupling ring 714 may comprise any variety of materials, such as but not limited to plastics, metals, rubbers, and the like. In the implementation illustrated in FIG. 14, the spool core 712, 713 each fit within the coupling ring 714. In other implementations, the support member 206 may fit within the coupling ring 714, while the coupling ring fits within the ends of the spool core 712, 713. The coupling ring 714 may attach to the spool cores 712, 713 through a number of different manners.

For example, in an implementation, the spool core 712, 713 may each comprise threading that allows the spool core 712, 713 to be screwed into corresponding threading on the coupling ring 714. Similarly, coupling ring 714 may be screwed into the ends of the either or both the spool cores 712, 713. In other implementations, an adhesive may be use to attach the coupling ring 714 to the spool cores 712, 713. The adhesive may be utilized whether the coupling ring 714 is inside the spool cores 712, 713, or outside the spool cores 712, 713. In still other implementations, the coupling ring 714 may be comprised of a stretch material that may be stretch to fit around the ends of the spool cores 712, 713, but then tightens to prevent the spool cores from rotating at different rates. In still other implementations, the coupling ring may comprise tape or other adhesive material wrapped around abutting ends of the spool cores 712, 713. In another implementation, the coupling ring 714 may comprise a clamp that is closed around abutting ends of the spool cores 712, 713.

Figure 15:
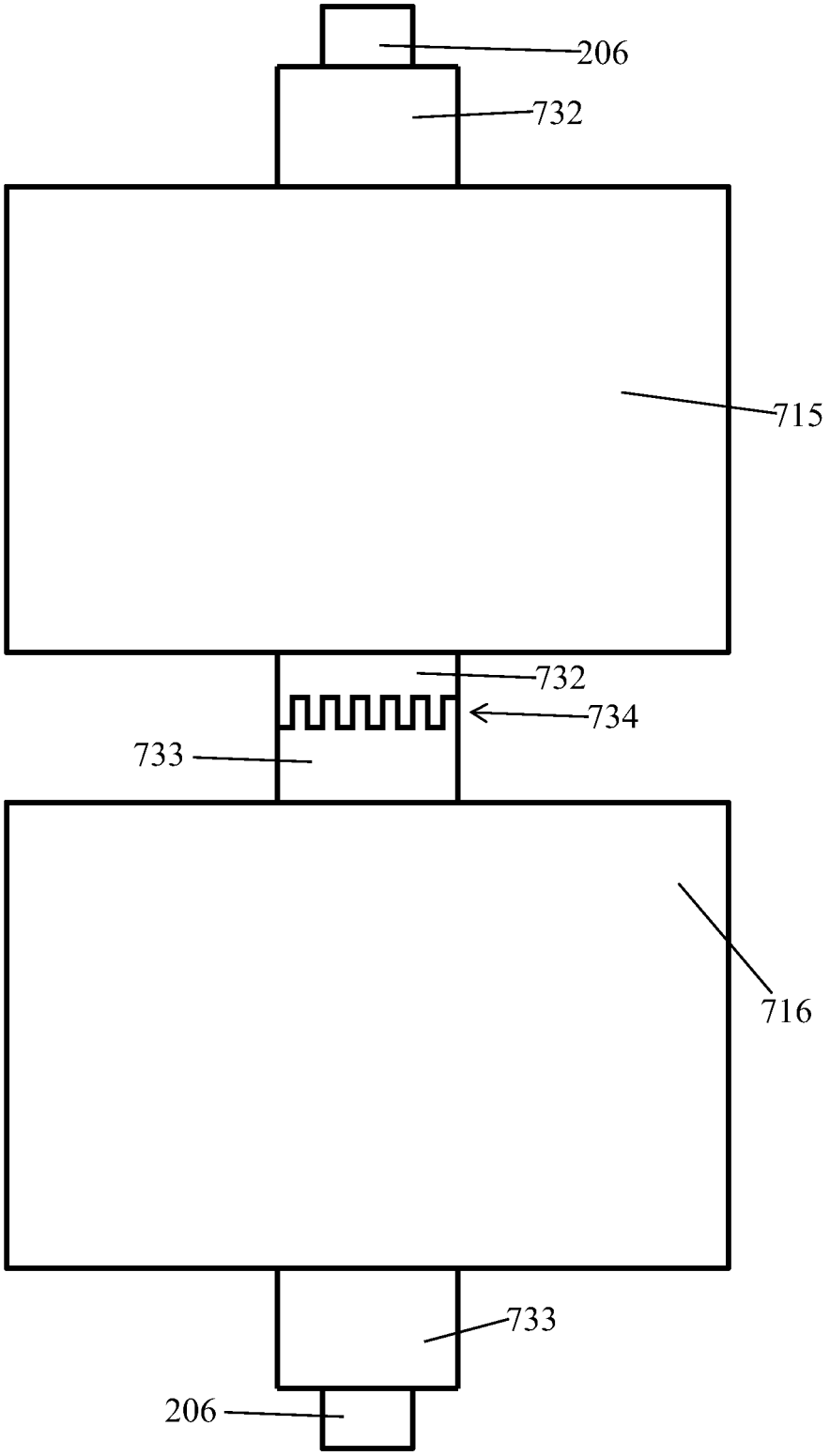
FIG. 15 is a side view of an implementation comprising two spool cores coupled together with integrated coupling clips in the form of coupling teeth.

Referring specifically to FIG. 15, in some implementations, the first spool core 732 and the second spool core 733 may be coupled together with a series of coupling clips 734 in the form of coupling teeth 734. The coupling teeth 734 may comprise any shape, size, or configuration that allows the teeth of the first spool core 732 to fit within gaps between the teeth of the second spool core 733, and vice versa. When engaged, with each other, the coupling teeth 734 prevent the spool cores 732, 733 from rotating at different rates as the rolls of stretch film 715, 716 are unwound or unrolled. The use of adhesives or a secondary coupling device may be utilized to enhance the effectiveness of the coupling teeth 734.

Figure 16:
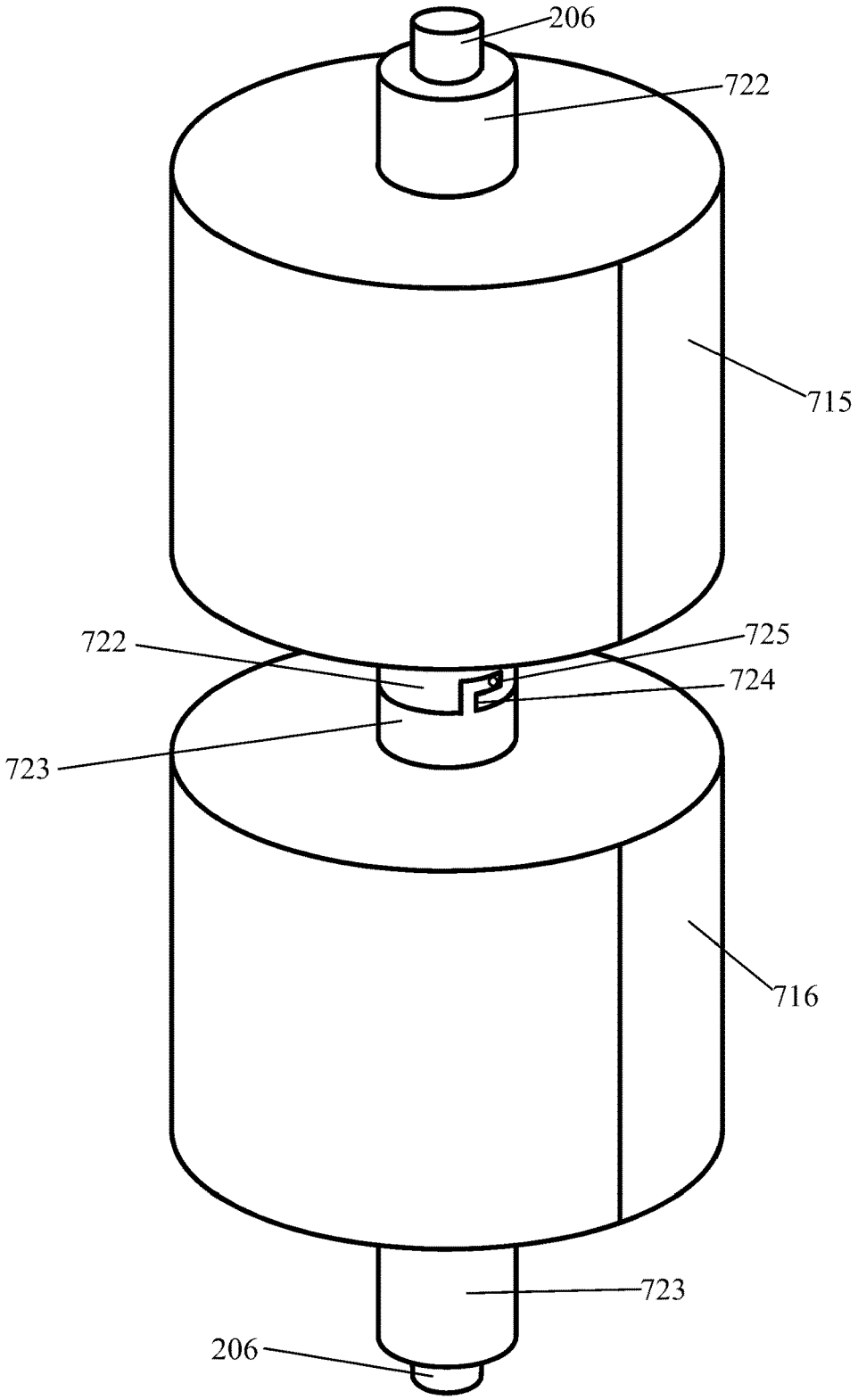
FIG. 16 is a perspective view of an implementation comprising two spool cores coupled together with a mated raised protrusion and angled slot to a palletized load.

Referring specifically to FIG. 16, in some implementations, an end of the second spool core 723 may fit within an end of the first spool core 722 with a coupling clip configured thereon. In the specific implementation of FIG. 16, the second spool core 723 comprises a coupling clip in the form of a protruding nub 725 that fits into an angled channel or reentrant opening 724 on the first spool core 722. When engaged in the reentrant opening 724, the nub 725 may act to lock the first 722 and second 723 spool cores together.

In other implementations, wherein an end of the second spool core 723 fits within an end of the first spool core 722, the spool core 722, 723 may be coupled together with a pin that fits within matching holes on the spool core 722, 723. In some implementations, the pin may also fit within a hole or depression on the support member 206.

In another implementation, the second spool core 723 may comprise a coupling clip in the form of a spring-loaded button and the first spool core may comprise a coupling clip in the form of a hole sized to fit the button within the hole. A user or a machine may then depress the button as the second spool core 723 is slid within the first spool 722. When the button meets the area of the hole of the firs spool core 722, the spring forces the button out, thus locking the end of the second spool core 723 in place such that both the first 722 and second 723 spool cores rotate at the same rate as the rolls 715, 716 are unwound.

In another implementation, an end of the second spool core 723 may comprise a coupling clip in the form of exterior threading that allows the end of the second spool core 723 to be screwed into corresponding coupling clip in the form of interior threading on the inside of an end of the first spool core 722.

Figure 7:
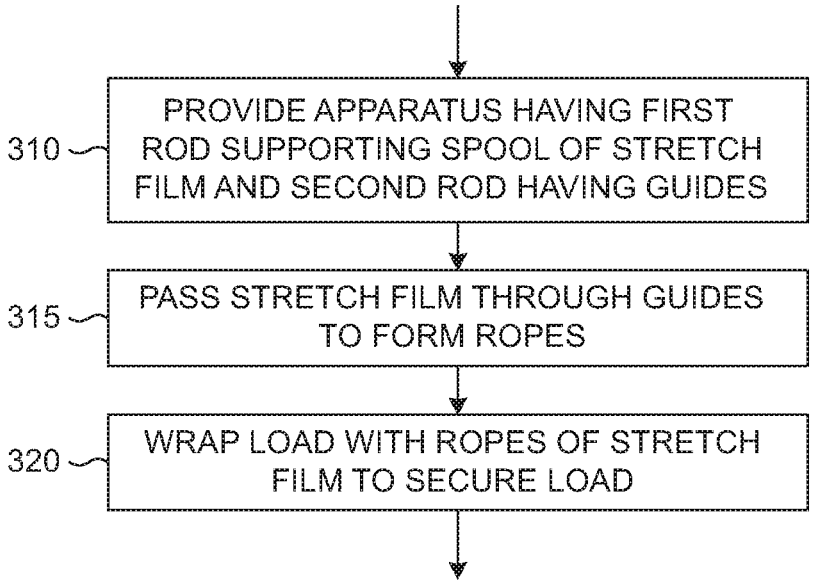
FIG. 7 is a flow diagram describing a particular implementation of a method of securing a palletized load.

FIG. 7 is a flow diagram describing a particular implementation of a method of securing a palletized load. According to this implementation of the method, an apparatus is provided, the apparatus having a first rod that supports a single spool supporting a plurality of rolls of stretch film and a second rod that supports a plurality of guides (step 310). The plurality of rolls of stretch film may be disposed on the single spool in essentially adjacent positions, i.e., substantially contiguously. As a particular example, the apparatus described supra with reference to FIG. 6 may be provided, wherein the apparatus comprises a spool support member 206, which may be a rod, supporting the spool 202 on which are wound first and second rolls of stretch film 215 and 216 disposed substantially contiguously. The second rod of the implementation of FIG. 7 may be implemented as, for example, the guide support member 261 illustrated in FIG. 6, the guide support member 261 being rigidly supported by the platform 205 and the bracket 210, and having pairs of guides 220 adjustably secured thereto by the plurality of collars 230.

The implementation of the method of FIG. 7 further comprises passing stretch film from the plurality of rolls through the plurality of guides to form a plurality of ropes of stretch film (step 315). As a specific example, FIG. 6 illustrates stretch film from first roll 215 and second roll 216 passing through guides formed by pairs of rollers 220 to form first rope 280 and second rope 281 of stretch film. As another example, FIG. 1 illustrates stretch film from first roll 15 and second roll 16 passing through ring-shaped first and second guides 30 and 31 to form first and second ropes of stretch film 50 and 51.

The implementation of the method illustrated in FIG. 7 still further comprises securing the palletized load by wrapping the palletized load with the plurality of ropes formed in step 315, thereby securing the palletized load (step 320). It should be noted that no cutting of stretch film is employed in the illustrated implementation of the method. Exemplary implementations of this securing step (i.e., step 320) are illustrated in FIGS. 2 and 5A. In FIG. 2, a user may transport a palletized load-wrapping apparatus around a palletized load, thereby securing the palletized load with first and second ropes 50 and 51 of stretch film. The first and second ropes 50 and 51 are formed by passing the stretch film through first and second guides 30 and 31. In FIG. 6, a stretch machine 270, operating as described herein, secures a palletized load 295 by wrapping first and second ropes 280 and 281 around the palletized load 295 as the palletized load 295 rotates. First and second ropes are formed by passing stretch film through guides formed by pairs of rollers 220. Neither the implementation of FIG. 2 nor the implementation of FIG. 6 includes a mechanism for cutting stretch film, nor does the implementation of FIG. 7 contemplate any cutting of stretch film.

Figure 8:
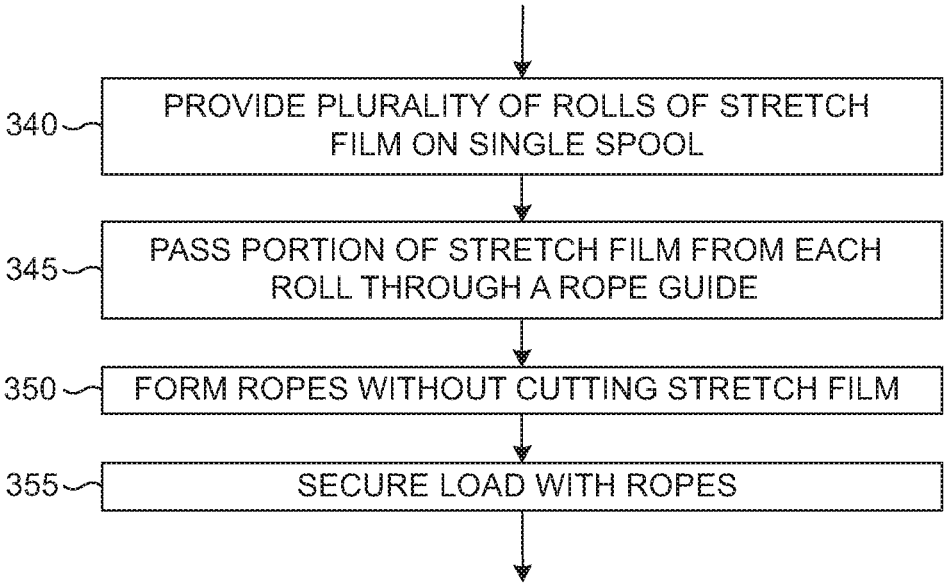
FIG. 8 is a flow diagram describing a particular implementation of a method of protecting a palletized load.

FIG. 8 is a flow diagram describing another particular implementation of a method of protecting a palletized load. According to the illustrated implementation, a plurality of rolls of stretch film (e.g., two or more rolls) is provided on a single spool (step 340). In a typical implementation, the single spool has an axis. A particular implementation that provides a plurality of rolls of stretch film is illustrated in FIG. 1, wherein is illustrated first and second rolls 15 and 16 of stretch film provided essentially contiguously positioned on a single spool 2. Another particular implementation that provides such a plurality of rolls of stretch film is shown in FIG. 6, which shows first and second rolls 215 and 216 on single spool 202.

The implementation of FIG. 7 further comprises passing a portion of stretch film from each roll through a rope guide (step 345). For example, stretch film from each of the first and second rolls 15 and 16 of stretch film may be passed through respective first and second guides 30 and 31 (functioning as rope guides) in the particular implementation shown in FIG. 1. As another example, FIG. 6 illustrates stretch film from each of first and second rolls 215 and 216 of stretch film passed through guides formed by pairs of rollers 220, the guides functioning as rope guides.

The implementation of FIG. 8 still further comprises forming a plurality of ropes without cutting the stretch film (step 350). One particular implementation of a method of forming the plurality of ropes is illustrated in the flow diagram of FIG. 9, described infra.

The implementation of FIG. 8 yet still further comprises securing the palletized load with the plurality of ropes (step 355). The securing may be accomplished using particular implementations already described. For example, FIG. 2 illustrates a pair of users cooperating to secure a palletized load. A first user (i.e. one having first arm 80 and second hand 81) moves around a palletized load while supporting an apparatus 10 adapted to form first and second ropes 50 and 51 of stretch film. A second user having hand 82, grasps initial ends of the first and second ropes 50 and 51. As the first user moves around the palletized load, the first and second ropes 50 and 51 become extended, wrapping, and thereby securing, the palletized load. As another example, a palletized load 295 may be secured as illustrated in FIG. 6 by first and second ropes 280 and 281 of stretch film formed by a stretch wrap machine 270 operating as described herein. As the palletized load 295 rotates on the rotatable platform 213, first and second ropes are extended and wrapped around the palletized load 295 to secure the palletized load 295.

Figure 9:
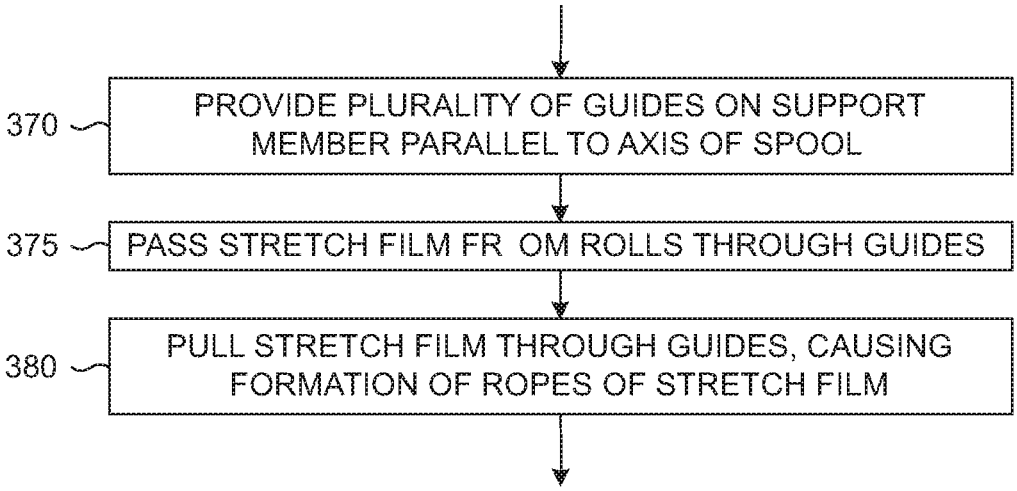
FIG. 9 is a flow diagram depicting a particular implementation of a method of forming a plurality of ropes according to the flow diagram of FIG. 8.

FIG. 9 is a flow diagram depicting a particular implementation of a method of forming a plurality of ropes according to the flow diagram of FIG. 8. The illustrated implementation comprises providing a plurality of guides (step 370)

adjustably secured to a support member disposed parallel to the axis of the spool referenced in step 340 of FIG. 8. For example, the providing of guides may be accomplished as illustrated in FIG. 2, wherein first and second guides 30 and 31 are adjustably secured to guide support member 20 by first and second collars 35 and 36. Guide support member 20 is secured in a position having its axis oriented in a direction parallel to an axis of the spool 2 by baseplate 40. In FIG. 6, a pair of guides is provided, each guide formed by a pair of rollers 220 adjustably secured to a guide support member 261 by collars 230, wherein the axis of the guide support member 261 is nominally parallel to the axis of the spool 202 as already described. The particular implementation of FIG. 9 further comprises passing stretch film from the plurality of rolls through the plurality of guides (step 375). See, for example, FIG. 1, wherein stretch film from first roll 15 and second roll 16 is passed through, respectively, first guide 30 and second guide 31. Similarly, in FIG. 6, stretch film from first roll 215 passes through a guide formed by a pair of rollers 220, and stretch film form second roll 216 passes through another guide formed by another pair of rollers 220.

The particular implementation of FIG. 9 still further comprises pulling stretch film through the plurality of guides in order to cause formation of the plurality of ropes of stretch film (step 380). This step may be accomplished as illustrated in FIG. 1 wherein, for example, first rope 50 is bunched up as stretch film from first roll 15 passes through the first guide 30, thereby forming the first rope 50. Additional ropes may be similarly formed. In FIG. 5, first rope 180 is formed when stretch film from a first roll is guided by a pair of rollers 120.

Figure 12:
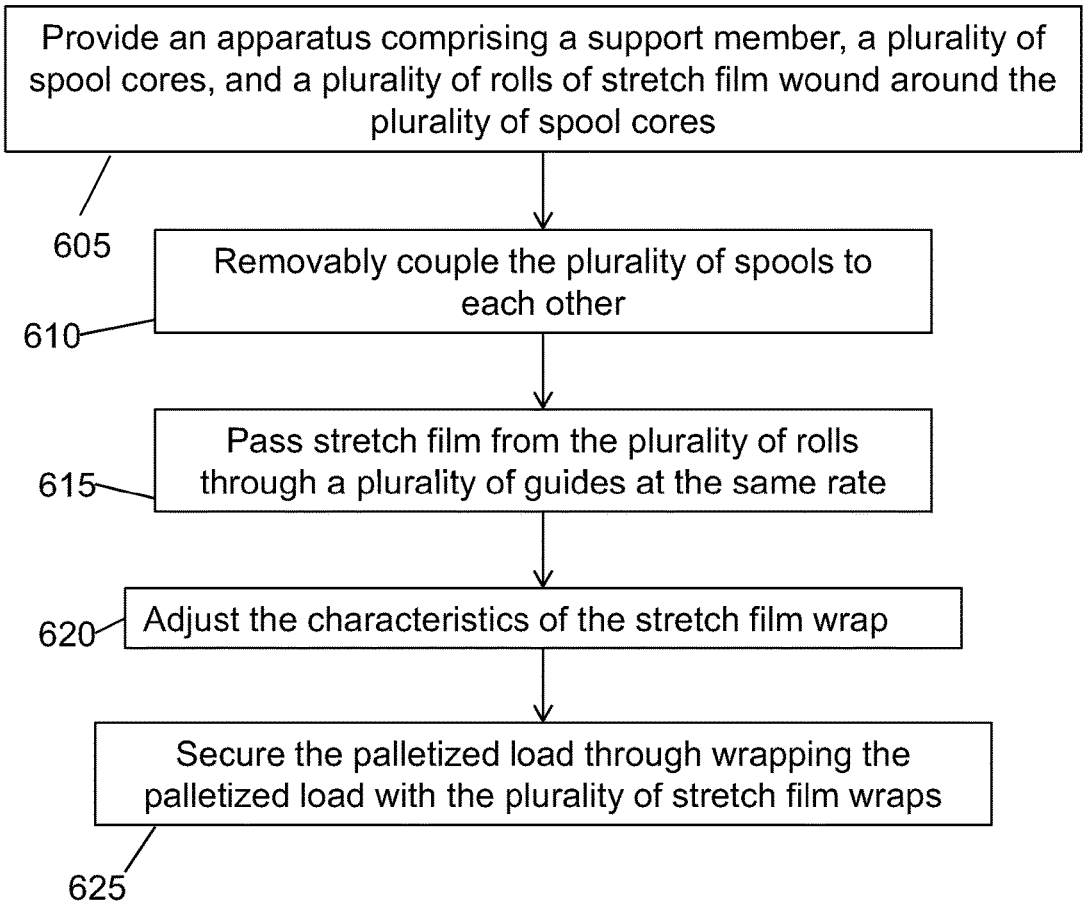
FIG. 12 is a flow diagram describing a particular implementation of a method of wrapping a palletized load.

FIG. 12 is a flow diagram depicting a particular implementation of a method of securing a palletized load. In an implementation, the method may comprise providing an apparatus comprising a support member, a plurality of spool cores, and a plurality of rolls of stretch film wound around the plurality of spool cores (step 605), at least one roll of stretch film on each of the plurality of spool cores. In an implementation of the method, the plurality of spool cores may comprise a first and at least a second spool core. The plurality of rolls of stretch film may comprise a first roll of stretch film and at least a second roll of stretch film. In various implementations, the plurality of rolls of stretch film wound around the plurality of spool cores may comprise the first roll of stretch film wound around the first spool core and the second roll of stretch film wound around the second spool core.

In an implementation, the method may further comprise removably coupling the plurality of spools to each other (step 610). Removably coupling or coupling the plurality of spools together in general ensures that all the plurality of spool cores rotate at the same rate when the plurality of rolls of film are unrolled.

In an implementation, the method may further comprise passing the stretch film from the plurality of rolls through a plurality of guides at the same rate (step 615). As the stretch film is passed from the plurality of rolls through the plurality of guides, a plurality of stretch film wrap bands or ropes are formed.

In an implementation, the method may further comprise adjusting the characteristics of the stretch film wrap (step 620). Adjusting the characteristics of the stretch film may comprise adjusting a width of one of the plurality of adjustable guides through which one of the plurality of stretch film wrap passes.

In an implementation, the method may further comprise securing the palletized load through wrapping the palletized load with the plurality of stretch film wraps (step 625). This may be accomplished after passing the stretch film through the plurality of adjustable guides.

It should be emphasized that positions of guides in the particular implementations of methods described in FIGS. 6-8 and FIG. 12 are adjustable as described with reference to, for example, FIG. 1 and FIG. 6. In a case of guides formed as rings (see, for example, FIG. 1), the rings may be adjusted either in a ganged arrangement or independently. Likewise, the guides formed by rollers 220 (FIG. 6) may be three-way adjustable: 1) Pairs of rollers may be moved in a ganged fashion; 2) pairs of rollers may be moved independently; and 3) rollers forming a pair may be moved farther apart or closer together in order to change a characteristic of ropes of stretch film according to preferences of a user.

Figure 10A:
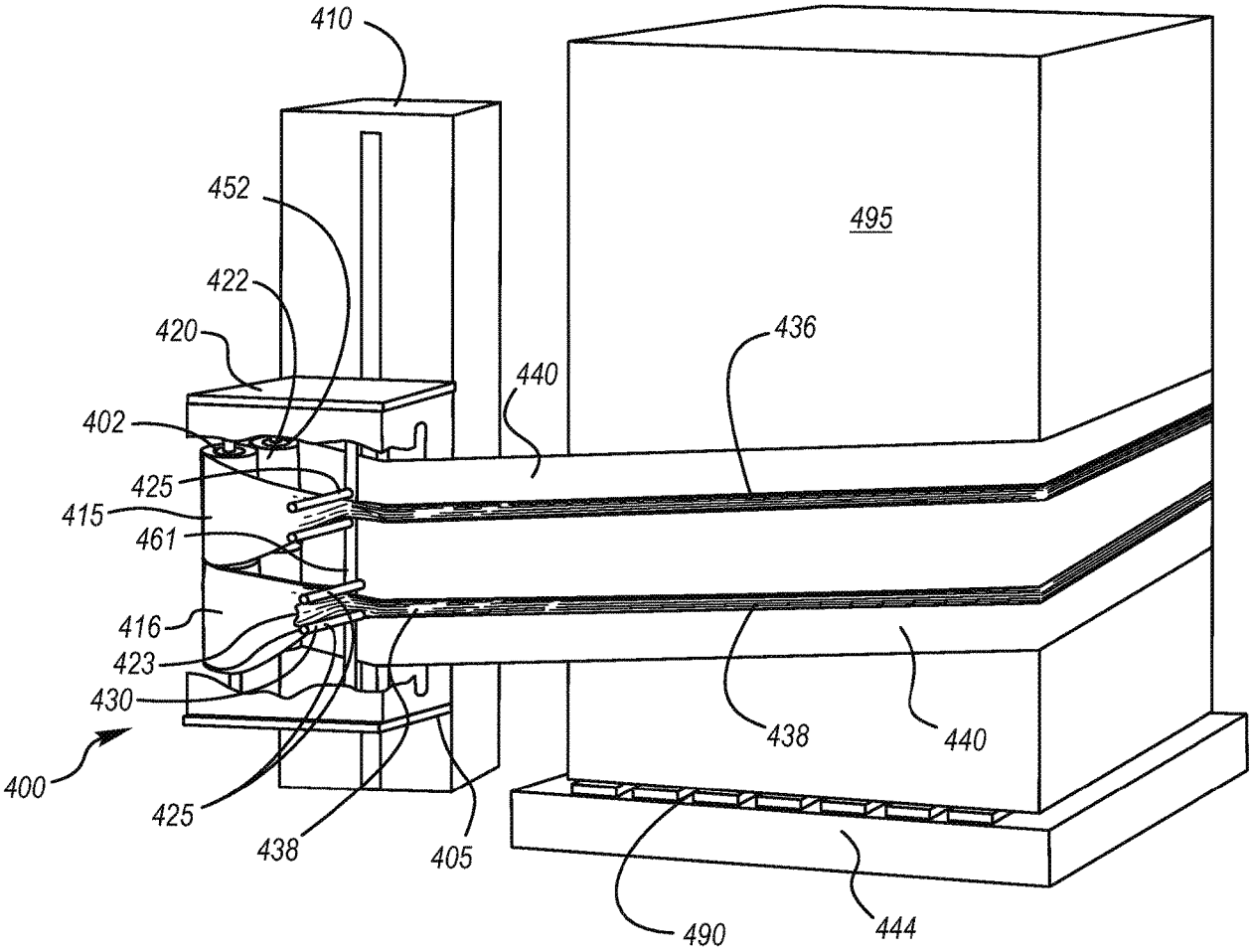
FIGS. 10*a*-10*d* are, respectively, four embodiments of a stretch wrap machine.

FIG. 10*a* is a pictorial diagram of a stretch wrap machine 400 that may include elements described with reference to FIG. 6. The illustrated implementation comprises carriage 405, moveably coupled to a carriage support 410. During operation of the stretch wrap machine 400, the carriage 405 is mechanically moved up and down the support 410 through a combination of gears and drives. A comparable carriage support and carriage system currently on the market is the SMH-200 Stretch Wrapper, sold by Wulftec International of QC, Canada. Those of ordinary skill in the art readily understand the use and operation of a conventional stretch wrapping machine of this type. FIG. 10*a* includes on the carriage 405 a conventional pre-stretch carriage 420 configured to stretch the stretch film passed through it prior to applying the stretch film to a pallet of goods to be wrapped, and at least one primary roll of stretch film 422 on a first or primary spool 452. Stretch film from spool 452 may be referred to as a web 440.

Different from a conventional stretch wrapping machine, however, the implementation of FIG. 10*a* includes at least a secondary roll of stretch film 415 or 416 supported on the carriage by a secondary spool 402. For this particular implementation, the stretch film web 440 from the first roll of stretch film 422 is simultaneously fed through the pre-stretch carriage 420 with the stretch film 436 and 438 from the at least a second roll of stretch film 415 or 416 after it has passed through guides 425. Typically, secondary rolls such as first and second rolls 415 and 416 are disposed next to each other on the second spool 402. The secondary rolls 415 and 416 may be disposed directly on a single secondary spool 402 or disposed on separate secondary spools that are then disposed on a common spool or roller (e.g. a common core with two spools around it and coupled to it) or coupled to one another as described elsewhere in this document, with the purpose that the secondary rolls 415 and 416 necessarily unroll at substantially the same rate. If the secondary rolls 415 and 416 do not spin at substantially the same rate, as is necessitated by being on the same spool 402 or being otherwise equivalently forced to spin at substantially the same rate, the operation is less effective. In an alternative embodiment, only a single secondary roll 416 is mounted on the second spool 402 and the film from the two separate rolls simultaneously feed through the pre-stretch carriage.

A guide support 461, which is also supported by and coupled to the carriage 405 and at a second end by bracket 410, may be disposed nominally parallel to and at a convenient distance from the second spool 402. That is, guide support 461 may have an axis that is parallel to the axis of the spool 402. A plurality of rollers 425, which may be arranged in pairs to form guides, two of which are illustrated, for example, in FIG. 10*a*, are adjustably connected with the guide support member 461 by a plurality of collars 430. The plurality of rollers 425 is positioned such that stretch film from secondary rolls 415 and 416 pass through the guide. The space between the guides 425 is the guide width 423. Alternatively, multiple guides extending from a common post may be coupled to the guide support member 461 to establish a guide width 423. The guide width 423 is less than the width of either the secondary roll 415 and 416, such that when stretch film is passed from secondary rolls 415 and 416 through roller guides 425, the width of each stretch film is narrowed to what is commonly referred to as a "rope" or alternatively referred to as a "band".

According to some aspects, the collars 430 may be configured so that positions of the plurality of rollers 425 may be adjusted on the guide support 461. In other embodiments, the rollers 425 or guides are fixedly positioned on the guide support 461. In a non-limiting embodiment like that shown in FIG. 10*a*, the rollers 425 are positioned such that each of the two ropes 436, 438 are positioned between a central portion 820 of the web 440 and a different edge of the two opposing edges 816, 818 of the web 440 when wrapped around the palletized load 495. In other embodiments, the rollers 425 may more particularly be positioned such that each of the two ropes 436 are positioned proximate opposing edges 816, 818 of the web 440 when wrapped around the palletized load 495.

Figure 10B:
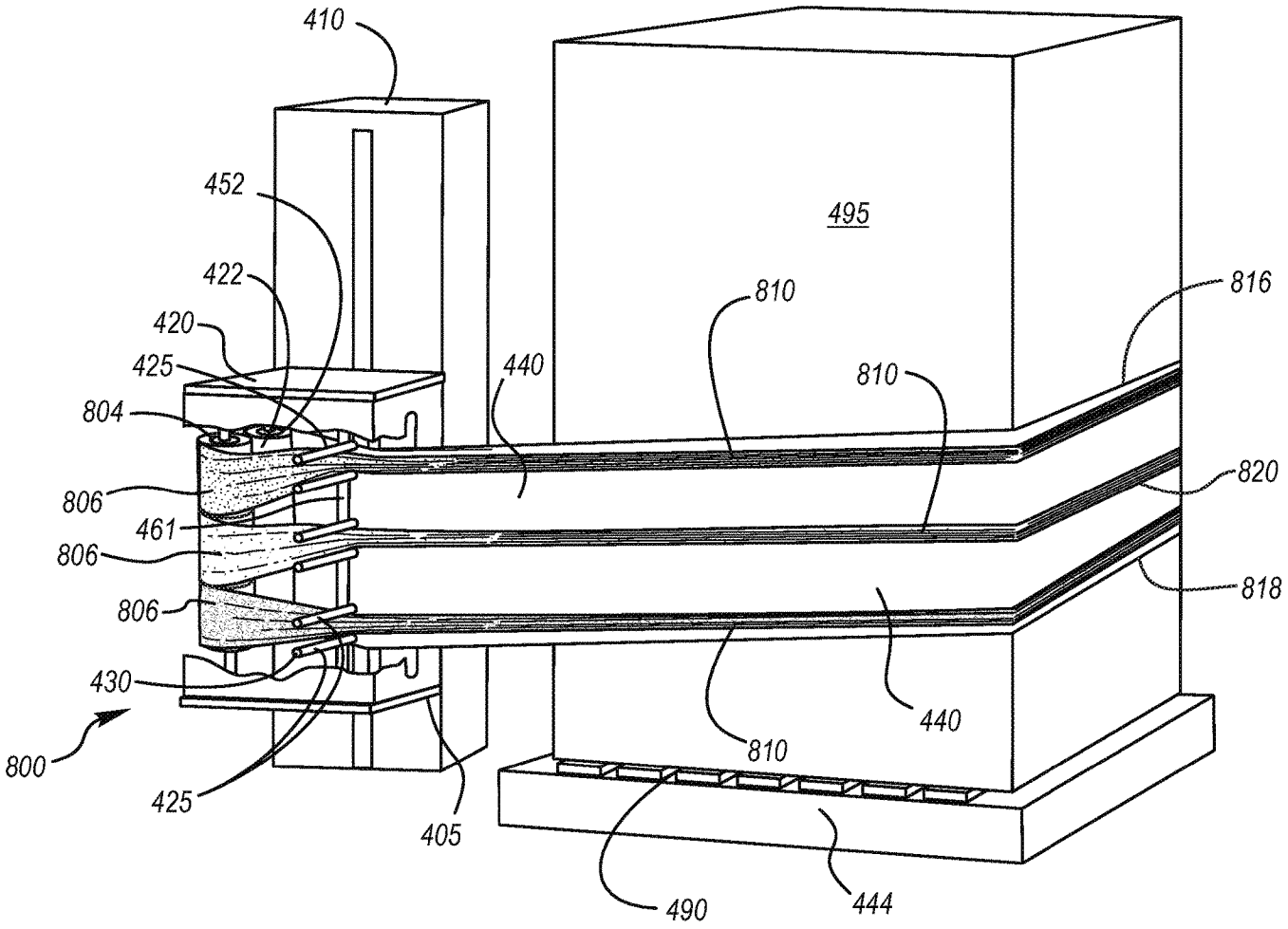
Figure 10C:
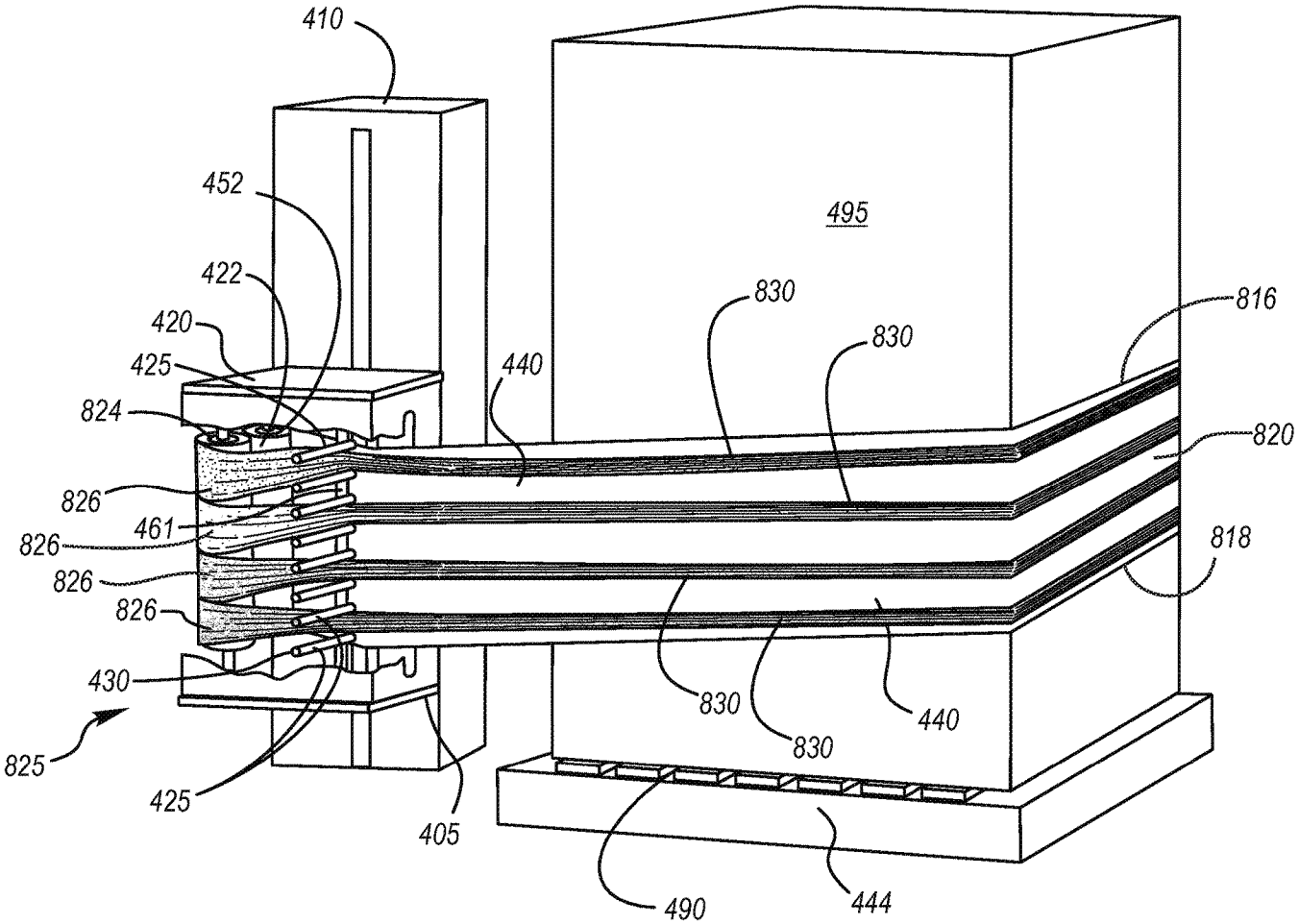
Figure 10D:
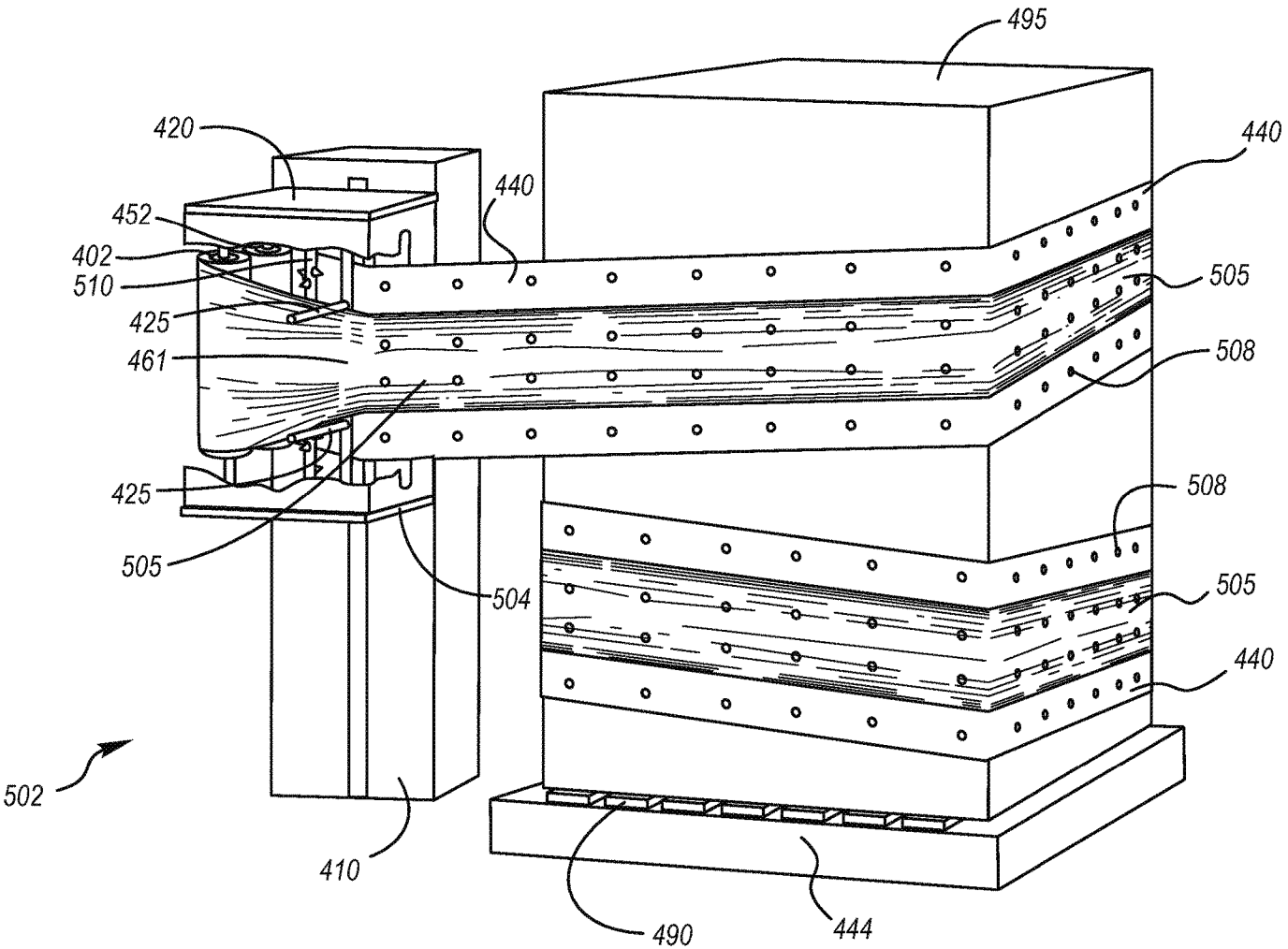

As stretch film from the secondary rolls 415 and 416 passes through a pair of guides (formed by pairs of rollers 425 in the implementation shown in FIGS. 10*a*-10*d*), first and second ropes 436 and 438 of stretch film are formed. This disclosure, further, contemplates using one roll or two or more rolls. A plurality of rolls of stretch film in order to form a plurality of ropes of stretch film by passing the stretch film through a plurality of guides could be more than two although only two rolls, guides and ropes are illustrated in FIG. 10*a*. FIG. 10*d* illustrates another particular implementation of a pallet wrapping system 502 with a carriage 504 moveably mounted to a support 410 as with the particular implementation of FIG. 10*a*, but this particular implementation includes a spool 402 with only a single roll of stretch film 505 wound around the spool 402 (rather than the two secondary rolls 415 and 416 of FIG. 10*a*). The setup for FIG. 10*d* still includes the guides 425 and guide support 461, but only one set of guides 425 to form only one wide rope 505. As illustrated, the first spool 452 feeds a web of stretch wrap 440 over a perforating spindle 510 having a plurality of pins/needles/spikes extending from it to perforate the web of stretch wrap 440 feeding across it before it enters the pre-stretch carriage 420.

Although, for purposes of clear illustration FIGS. 10*a*-10*d* are shown to simultaneously dispose the web 440 and the ropes 436 and 438 or 505 on the palletized load with the web 440 closest to the load, this is not required and in some cases not preferred. In alternate implementations of any of the various embodiments described throughout this disclosure may be accomplished by simply reversing the positions of the rolls, or by wrapping the palletized load the other direction. In such implementations, the ropes 436 and 438 or 505 will be simultaneously disposed on the palletized load with the web 440 with the ropes 436 and 438 or 505 closest to the palletized load. In particular applications it may be desirable and advantageous to have the web 440 closest to the load while wrapping and in other applications it may be desirable and advantageous to have the web 440 covering the ropes 436 and 438 or 505 depending upon the type of load being wrapped and whether the web 440 and/or ropes 436 and 438 or 505 are perforated.

Embodiments of stretch wrap machines having a plurality of ropes 436, 438 that fully overlap the web 440 are advantageous to conventional strep wrap machines having ropes that do not fully overlap the web or only a single rope that fully overlaps the web. As used herein, the term fully overlapping or fully overlaps means that the edges of the rope 436, 438 are positioned between the edges of the web 440 when the applied to a palletized load 495.

Having a plurality of ropes that fully overlap the web 440 acts as reinforcement to the web 440. Conventional wrapping machines and techniques typically utilize three to five wraps at the bottom of the load and three to five wraps at the top of the load. This results in little strength in the middle of the palletized load. To remedy this, users of conventional wrapping machines are required to hand-wrap the load again for extra strength, particularly in the middle. By utilizing stretch wrap machines having a plurality of ropes that fully overlap the web, as contemplated herein, the middle of a palletized load is wrapped at strengths that far exceed conventional wrapping machines.

Another advantage of a stretch wrap apparatus having a plurality of ropes that fully overlap the web when applied to a palletized load is tear-inhibiting effect of the ropes on the web. Such tears may occur after contact with an object or may even occur as a manufacturing defect of the wrap. In conventional pallet wrapping machines, when the web starts to tear or cut, the tear or cut continues unabated until the tear meets the edge of the web and the web separates. In embodiments of a wrapping apparatus having a plurality of ropes that fully overlap the web, the tear is inhibited or stopped from progressing beyond the rope due to the extra strength and reinforcement applied to the web by the rope. One rope is typically not enough to prevent tears of significant distance that detrimentally comprise the strength of the web.

Another advantage of a stretch wrap apparatus having a plurality of ropes that fully overlap the web when applied to a palletized load is the ability for user to cut a portion of the wrap off a palletized load without the remaining wrap becoming unraveled or significantly loosened. For example, a user may wish to remove only a top half of a wrapped palletized load and leave the bottom half of the load still wrapped. If a palletized load is wrapped with a stretch wrap apparatus having a plurality of ropes that fully overlap the web, then a user may cut the wrap at the level he/she desires and remove the wrap above the cut. The wrap below the cut remains wrapped around the load due to the plurality of ropes and maintains the strength of the wrap sufficient to hold the load. Thus, the ropes reinforce and help hold the initial tension around the wrapped load. If a user made a similar cut or partially unwraps a palletized load after wrapping with a conventional stretch wrap apparatus, the wrapping below the cut would unravel because the cut or tears would run uninhibited by any ropes, and the opposing sides around where the wrap is cut would unravel. Moreover, the remaining wrap will likely be significantly loosened because of the relatively low tension applied to original palletized load, thus providing very minimal containment for the remaining products on the pallet.

Another advantage of a stretch wrap apparatus having a plurality of ropes that fully overlap the web when applied to a palletized load is the ability for a user to "triangulate" at sharp angles to help pull the products on a palletized load together as a single unitized load. This triangulation inhibits sway and movement of the load. In contrast, if a user attempts to triangulate with a conventional stretch wrap apparatus with the same amount or number of wraps and the same gauge of film as particular embodiments of this disclosure, the conventional stretch wrap apparatus results in a reduced load-holding strength when compared to the particular embodiments.

Another advantage of a stretch wrap apparatus having a plurality of ropes that fully overlap the web when applied to a palletized load is a reduction in the amount of wrap applied to a palletized load in comparison to conventional stretch wrap machines. By utilizing a plurality of ropes that fully overlap a web, a palletized load may be wrapped with a relatively high degree of tension that results in a relatively high load-holding force that uses less film than conventional stretch wrap machines, requires less time than conventional stretch wrap machines, and fewer machines hours than conventional stretch wrap machines.

By way of contrast, in a conventional stretch wrap machine the user typically cannot apply much tension to gain a significant load-holding force because the conventional wrap becomes more vulnerable to tears and punctures. These tears and punctures easily proliferate without a plurality of ropes, as described above. To compensate for the effect of wrap having a lower overall tension, the user typically applies more total wraps and film around the palletized load. These results in an increased amount of time required wrapping the palletized load, which may create a bottleneck in the production lines. This also results in more stretch wrap machine hours, which may lead to more wear and tear on the stretch wrap machine.

Another similar advantage of a stretch wrap machine or apparatus having a plurality of ropes that fully overlap the web when applied to a palletized load is a reduced overall cost in wrapping material. Use of a stretch wrap apparatus having a plurality of ropes that fully overlap the web reduces overall costs in areas such as but not limited to total film required to securely wrap a load, product wear and tear, time, and product change-over. Also, lighter rolls of wrap may be used in certain embodiments.

FIGS. 10*b* and 10*c* depict additional non-limiting embodiments of stretch wrap machines or apparatus having a plurality of ropes that fully overlap the web when applying to and securing a palletized load. These and other embodiments of a stretch wrap machine having a plurality of ropes that fully overlap the web when applied to a palletized load may include all of the advantages described above when compared to conventional wrapping machines. Additionally, unless otherwise specified, embodiments of the stretch wrap machines in FIGS. 10*b* and 10*c* may comprise any of the parts described elsewhere in this documents, such as but not limited to primary or first spools 452, a primary roll 422 of stretch film, a web 440 of stretch film from the primary roll 422 of stretch film, a pre-stretch carriage 420, guides and rollers 425, rollers 430, guide support 461, and carriage support 410. Furthermore, the principles and features discussed in relation to FIGS. 10*b* and 10*c* may be included in any of the other embodiments shown and/or described herein.

FIG. 10*b* depicts a non-limiting embodiment of a stretch wrap machine 800 for securing a palletized load. According to some aspects a stretch wrap machine 800 is configured to wrap a web 440 and a three ropes 810 around a palletized load 495. In such embodiments, the stretch wrap machine 800 comprises a primary roll 422 of stretch film supported by a first or primary spool support member. Like other embodiments previously described, the stretch film of the primary roll 422 forms a web 440 around the palletized load as the stretch wrap machine 800 rotates around the palletized load (or the palletized load rotates adjacent the stretch wrap machine 800). When wrapped around the palletized load 495, the web 440 comprises a top or first edge 816 and a bottom or second edge 818.

One or more embodiments of a stretch wrap machine 800 further comprise three secondary rolls 806 of stretch film supported by a secondary spool support member. The three secondary rolls 806 of stretch film may each be positionally coupled to the same secondary spool 804. Alternatively, the three secondary rolls 806 of stretch film may each be positionally coupled to a different secondary spool, with each of the three different secondary spools being coupled to one another. In either configuration, the three secondary rolls 806 unwind at substantially the same rate due to the positional coupling of the secondary rolls 806 to either the same secondary spool core 804 or different spool cores coupled to one another.

In a stretch wrap machine 800 embodiment comprising three secondary rolls 806 of stretch film, the stretch wrap machine typically comprises three sets of rollers 425 or guides. In particular embodiments using multiple fully overlapped webs, although separate secondary rolls of stretch film may be used, a common roll of stretch film that is then cut into sections after leaving the roll but before entering the separate guides may be used. The three sets of rollers 425 or guides may comprise any of the rollers 425 or guides described elsewhere in this document. According to some aspects, a stretch wrap machine 800 comprises collars 430 configured so that positions of the plurality of rollers 425 may be adjusted on the guide support 461. In other embodiments, the rollers 425 or guides are fixedly positioned on the guide support 461. In a non-limiting embodiment like that shown in FIG. 10*b*, the rollers 425 are positioned such that a first and second of the ropes 810 are positioned between a central portion 820 of the web 440 and a different edge of the two opposing edges 816, 818 of the web 440 and a third rope is positioned approximately central between the two edges 816, 818 of the web when wrapped around the palletized load 495. In other embodiments, the rollers 425 may more particularly be positioned such that the first and second ropes 810 are positioned proximate opposing edges 816, 818 of the web 440 and a third rope is positioned approximately central 820 between the opposing edges 816, 818 of the web 440 when wrapped around the palletized load 495.

FIG. 10*c* depicts a non-limiting embodiment of a stretch wrap machine 825 for securing a palletized load. According to some aspects a stretch wrap machine 825 is configured to wrap a web 440 and a four ropes 830 around a palletized load 495. In such embodiments, the stretch wrap machine 825 comprises a primary roll 422 of stretch film supported by a first or primary spool support member. Like other embodiments previously described, the stretch film of the primary roll 422 forms a web 440 around the palletized load as the stretch wrap machine 825 rotates around the palletized load (or the palletized load rotates adjacent the stretch wrap machine 825). When wrapped around the palletized load 495, the web 440 comprises a top or first edge 816 and a bottom or second edge 818.

One or more embodiments of a stretch wrap machine 825 further comprise four secondary rolls 826 of stretch film supported by a secondary spool support member. The four secondary rolls 826 of stretch film may each be positionally coupled to the same secondary spool 824. Alternatively, the four secondary rolls 826 of stretch film may each be positionally coupled to a different secondary spool, with each of the four different secondary spools being coupled to one another. In either configuration, the four secondary rolls 826 unwind at substantially the same rate due to the positional coupling of the secondary rolls 826 to either the same secondary spool core 824 or different spool cores coupled to one another.

In a stretch wrap machine 825 embodiment comprising four secondary rolls 826 of stretch film, the stretch wrap machine typically comprises four sets of rollers 425 or guides. The four sets of rollers 425 or guides may comprise any of the rollers 425 or guides described elsewhere in this document. According to some aspects, a stretch wrap machine 825 comprises collars 430 configured so that positions of the plurality of rollers 425 may be adjusted on the guide support 461. In other embodiments, the rollers 425 or guides are fixedly positioned on the guide support 461. In a non-limiting embodiment like that shown in FIG. 10*c*, the rollers 425 are positioned such that a first and second of the four ropes 830 are positioned between a central portion 820 of the web 440 and a different edge of the two opposing edges 816, 818 of the web 440 and a third and fourth of the four ropes are positioned between the first and second ropes of the four ropes 830 when wrapped around the palletized load 495. In other embodiments, the rollers 425 may more particularly be positioned such that the first and second ropes 830 are positioned proximate opposing edges 816, 818 of the web 440 and a third and a fourth of the four ropes are positioned between the first and second ropes 830 when wrapped around the palletized load 495. In either or other configurations, the ropes 830 may be substantially parallel and/or positioned approximately equal distance from the nearest adjacent rope 830.

In particular implementations, such as that shown in FIG. 10*d*, the stretch film rope 505 from the secondary spool 402 may be fed across the perforating spindle 510 with the web of stretch wrap 440 to perforate it as well. As the stretch wrap 440 is stretched in the pre-stretch carriage 420 and applied to the pallet load 495, the perforated holes 508 are stretched much larger than their initial diameter forming a netting to allow air flow to the product being wrapped. It is contemplated that embodiments like that illustrated in FIG. 10*d* where the stretch wrap rope 505 does not become perforated, the rope maintains its full strength, but that other embodiments may perforate the rope/band as well or that in other particular implementations a separate perforating spindle with fewer pins/needles/spikes may be used for the rope to provide some air flow but not weaken the rope too much. Embodiments of the stretch wrap machines 400, 800, and 825 may incorporate a perforating spindle 510 similar to that shown in FIG. 10*d* without departing from the scope of this disclosure. In such embodiments, the perforating spindle 510 may be positioned to perforate the primary roll 422 and/or web 440 of stretch film without perforating the secondary rolls and/or ropes of stretch film. In other embodiments, the perforating spindle 510 may be positioned to perforate both the primary roll 422 and the secondary rolls of stretch film as the stretch film is wrapped around the palletized load 495.

Also contemplated as part of this disclosure is a method of inhibiting tearing of stretch film wrapped around a palletized load 495. According to some aspects, a method of inhibiting tearing of stretch film wrapped around a palletized load comprises dispensing a primary roll 422 of stretch film supported on a first support member and dispensing, at substantially a same rate, at least two secondary rolls 415, 416, 806 or 826 of stretch film supported by a secondary support member. Aspects of a method further comprise narrowing a width of each of the at least two secondary rolls 415, 416, 806, 826 with at least two sets of guides 425 to form at least two ropes 436, 438, 810, or 830 and positioning, with the at least two sets of guides 425, the at least two bands 436, 438, 810, or 830 to fully overlap the primary roll 422. Embodiments of a method may further comprise simultaneously applying the primary roll 422 and the at least two ropes 436, 438, 810, or 830 to a palletized load such that the at least two ropes 436, 438, 810, or 830 fully overlap a web 440 formed by the application of the primary roll around the palletized load.

Aspects of a method of inhibiting tearing of stretch film wrapped around a palletized load may further comprise positioning, with the sets of guides 425, the at least two ropes 436, 438, 810, or 830 at strategically desired positions. The strategically desired positions may be as described elsewhere in this documents, such as but not limited to proximate edges 816, 818 of the web 440, central 820 to the web 440, equal distance from one another, and/or any combination thereof.

It is also contemplated that in one or more embodiments, the secondary roll of stretch film is colored differently than the primary roll of stretch film. For example, in the non-limiting embodiments of FIGS. 10*b* and 10*c*, the secondary rolls 806, 826, respectively, are colored differently than the primary roll 422 of stretch film. It is also contemplated that the secondary rolls 415, 416 of FIGS. 10*a* and 10*d* may be colored differently than the primary roll 422 of stretch film. In such embodiments, the stretch wrap machine is also a tamper deterring apparatus for securing a palletized load.

In conventional stretch wrap machines, any stretch wrap used to wrap a palletized load is typically all the same color, such as but not limited to transparent stretch wrap. When a palletized load is wrapped with conventional stretch wrap machines, unauthorized individuals may easily cut the stretch wrap, access and remove some of the palletized load, and then wrap new stretch wrap around the palletized load to seal the cut stretch wrap. Once the new stretch wrap is applied to the load, the cut is no longer visible.

Embodiments comprising secondary rolls 806 or 826 that are colored differently than a primary roll 422 are advantageous to convention stretch wrap machines because the colored ropes 810 or 830 act as a deterrent to tampering with the palletized load 495 after the web 440 and colored ropes 810 or 830 are applied to the palletized load 495. For example, because the ropes 810 or 830 are colored differently than the web 440, if an unauthorized individual cuts through the web 440 and ropes 810 or 830, the cut cannot be concealed because the colored ropes 810 or 830 would be misaligned or covered in new wrap if the unauthorized individual tried to cover the cut with new stretch wrap. Thus, having secondary rolls 806 or 826 that are colored differently than the primary roll 422 deters tampering with a palletized load 495 after wrapping. Similarly, such a configuration of ropes 810 or 830 colored differently than the web 440 may also help detect shipping damage before unwrapping of the palletized load 495.

Figure 11A:
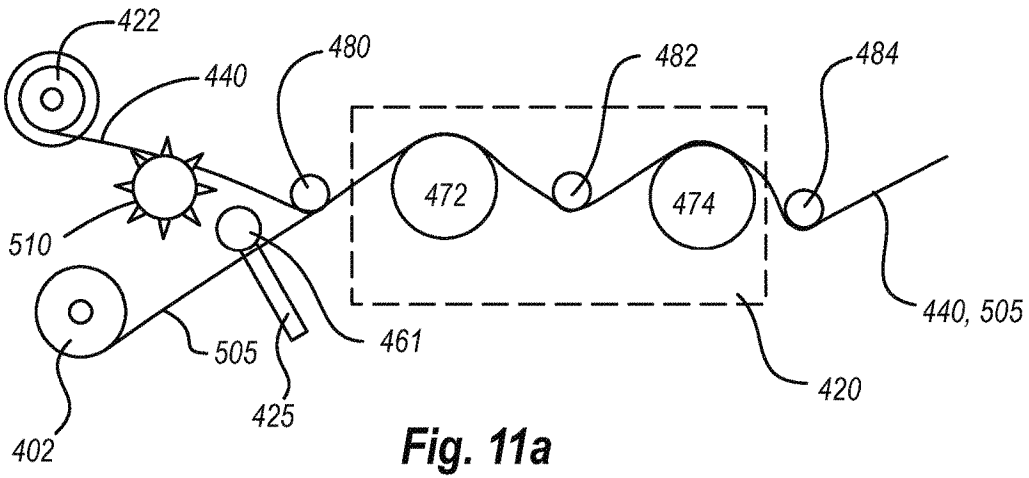
FIGS. 11*a* and 11*b* are, respectively, representative top and side views of the path of stretch film travel from the rolls of stretch film through one particular embodiment of a pre-stretch carriage.
Figure 11B:
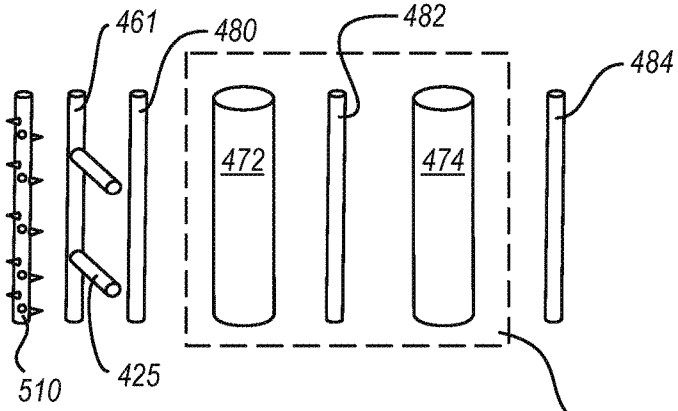

A pre-stretch carriage 420 may comprise any combination of rollers and components to pre-stretch the film being passed through it prior to applying the film to the pallet load 495 being wrapped. In the particular implementation illustrated by the rollers in FIGS. 11*a* and 11*b*, the pre-stretch carriage 420 comprises pre-stretch rollers 472 and 474 and idle roller 482. FIG. 11*a* represents the path of the various stretch films 440 and 505 as they pass from the spools 402, 452 through the pre-stretch carriage 420 on their way to the pallet load 495 FIG. 10*a*) to be wrapped. FIG. 11*b* represents the various components without the particular housing or the film shown for clarity. Adjacent to pre-stretch carriage 420 are idle rollers 480 and 484. It should be understood that idle rollers 480 and 484 may also be located within pre-stretch carriage 420 with no change in functionality and that other particular configurations may alternatively be used. Pre-stretch rollers 472 and 474 may be of different diameters, causing the stretch film to become stretched as it passes through pre-stretch carriage 420.

FIG. 11*a* shows a top view of pre-stretch carriage 420 to illustrate the path taken by one or more stretch wrap ropes 505 and stretch wrap web 440 as they simultaneously traverse through pre-stretch carriage 420. In this particular implementation, only one stretch wrap rope 505 is illustrated, though as with other embodiments shown and described herein, multiple stretch wrap ropes may be used. Stretch wrap web 440 passes over the perforating spindle 510, where it is perforated as described above. Thereafter, the combination of the one or more stretch wrap ropes 505 and the stretch wrap web 440 wind past idle roller 480, pre-stretch roller 472, idle roller 482, pre-stretch roller 474, and idle roller 484. Pre-stretch rollers 472 and 474 may be of different diameters. Thus, as the one or more stretch wrap ropes 505 and the stretch wrap web 440 pass through the rollers, the different diameters of pre-stretch rollers 472 and 474 cause the ropes 505 and web 440 to stretch simultaneously. It should be understood that other configurations of pre-stretch carriage 420 may be used in conjunction with stretch wrap machines 400, 502.

The stretch wrap system 400, 502 may comprise a common support (not shown) for the carriage support 410 and a rotatable platform 444 on which may be placed a pallet 490 with a load 495 of palletized goods. The arrangement of the load 495 is not critical to this disclosure and has been shown as a non-descript cube for simplicity.

In operation, and with reference to the respective portions of both FIGS. 10*a*-10*d*, the pallet 490 and the palletized load 495 may arrive at the stretch wrap machine 400, 502 and may be placed onto the rotatable platform 444. One or more stretch wrap ropes 436, 438 and 505 may be formed as described herein in addition to the stretch wrap web. As illustrated in FIG. 11*a*, a portion of the path of the stretch wrap ropes 436, 438 and 505 from the second spool 402 to the palletized load 495 overlaps with a portion of the path of stretch wrap web 440 from the first spool 452 to the palletized load 495 after the one or more stretch wrap ropes 436, 438 and 505 pass through guides 425 so that the one or more ropes and the stretch wrap web 440 are applied to the palletized load 495 simultaneously. In one embodiment, a pre-stretch carriage 420 is along the overlapping path such that the paths overlap through pre-stretch carriage 420. Then the ropes and web 440 combination are attached at initial ends (not illustrated) to the palletized load 495 in a known manner. The rotatable platform 444 then may be rotated (using, for example, a known type of motor and shaft arrangement as is conventional with this type of stretch wrapping system), thereby pulling stretch film through the guides and extending the at least one rope 436, 438 and 505 and the stretch wrap web 440 to wrap the palletized goods 495 as already described. The carriage 420 is moved up and down on the carriage support 410 as the pallet turns to wrap the pallet, overlapping combinations of previously simultaneously applied rope and web layers. It should be understood that the use of pre-stretch carriage 420 is optional as is the perforating spindle 510. The combination of one or more ropes 436, 438 and 505 with stretch wrap web 440 may be performed without pre-stretching.

It will be understood that implementations are not limited to the specific components disclosed herein, as virtually any components consistent with the intended operation of a method and/or system implementation for securing palletized loads may be utilized. Accordingly, for example, although particular components may be disclosed, such components may comprise any shape, size, style, type, model, version, class, grade, gauge, measurement, concentration, material, weight, quantity, and/or the like consistent with the intended operation of a method and/or system implementation for a palletized load wrapping machine may be used. By specific example, another method and apparatus for wrapping a palletized load known in the art involves a palletized load remaining stationary and the wrapping carriage moving up and down and around the palletized load. It is specifically contemplated that the wrapping carriages of these methods and apparatus would be readily modified by those of ordinary skill in the art to include the advantages of the wrapping carriages and machines identified in this disclosure. Accordingly, it is considered within the scope of this disclosure to include such methods and apparatus adapted to include the carriages and methods described within this disclosure relating to rotating palletized loads.

In places where the description above refers to particular implementations of palletized load-wrapping apparatus, it should be readily apparent that a number of modifications may be made without departing from the spirit thereof and that these implementations may be applied to other forms of devices that secure palletized loads. In particular, the above description describes hand-held and stationary versions of palletized load-wrapping machines. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

It is claimed:

1. A method of inhibiting tearing of stretch film wrapped around a palletized load, comprising:

dispensing a primary roll of stretch film supported on a first support member;

dispensing at substantially the same rate at least one secondary roll of stretch film supported by a second support member;

narrowing a width of the at least one secondary roll with at least one set of guides to a width less than a width of the primary roll;

positioning, with the at least one set of guides, the stretch film from the at least one secondary roll to overlap the stretch film of the stretch film from primary roll within the width of the primary roll; and simultaneously applying the stretch film from the primary roll and the stretch film from the at least one secondary roll to a palletized load such that the stretch film from the at least one secondary roll overlaps the stretch film from the primary roll within the width of the stretch film from the primary roll before the stretch film from the primary roll and the stretch film from the at least one secondary roll are applied around the palletized load.

2. The method of claim 1, wherein the at least one set of guides comprises at least two sets of guides and positioning comprises:

positioning, with a first set of guides of the least two sets of guides, a first rope formed of a first portion of the stretch film from the at least one secondary roll between a central portion of the stretch film from the primary roll and a first edge of the stretch film from the primary roll; and positioning, with a second set of guides of the at least two sets of guides, a second rope formed of a second portion of the stretch film from the at least one secondary roll between the central portion and a second edge of the stretch film from the primary roll.

3. The method of claim 2, wherein the at least two sets of guides comprises at least three sets of guides, the at least one secondary roll comprises at least three secondary rolls, and further comprising a third rope formed of a third portion of the stretch film from the at least one secondary roll, the method further comprising positioning, with a third set of guides of the at least three sets of guides, the third rope approximately central between the first edge and the second edge of the stretch film from the primary roll.

4. The method of claim 2, wherein the at least two sets of guides comprises at least four sets of guides, the at least one secondary roll comprises at least four secondary rolls, and further comprising a third rope formed of a third portion of the stretch film from the at least one secondary roll and a fourth rope formed of a fourth portion of the stretch film from the at least one secondary roll, the method further comprising:

positioning, with a third set of guides of the at least four sets of guides, the third rope between the first edge and the second edge of the stretch film from the primary roll; and positioning, with a fourth set of guides of the at least four sets of guides, the fourth rope between the first edge and the second edge of the stretch film from the primary roll such that each rope of the first, second, third and fourth ropes is equal distance from the adjacent rope of the four ropes.

5. The method of claim 1, further comprising simultaneously pre-stretching the stretch film from the primary roll and the stretch film from the at least one secondary roll while the stretch film from the at least one secondary roll is overlapped with the stretch film from the primary roll prior to applying the stretch film from the primary roll and the stretch film from the at least one second roll to the palletized load.

6. The method of claim 1, further comprising perforating the stretch film from the primary roll and the stretch film from the at least one secondary roll before applying the stretch film from the primary roll and the stretch film from the at least one secondary roll to the palletized load.

7. An apparatus for securing a palletized load, comprising:

a primary roll of stretch film supported by a first spool support member, the primary roll comprising a width defined by top and bottom edges of the stretch film;

a secondary roll of stretch film supported by at least a second spool support member; and a first set of guides comprising a first guide width between two guides of the set of guides, the first guide width being less than a width of the secondary roll, wherein the two guides are positioned to receive the secondary roll stretch film, narrow the secondary roll stretch film to a width less than the width of the primary roll, and after narrowing the secondary roll stretch film positioning the secondary roll stretch film to overlap the secondary roll stretch film onto the primary roll stretch film between the top and bottom edges of the primary roll stretch film as the primary roll stretch film and the secondary roll stretch film are wrapped around a palletized load.

8. The apparatus of claim 7, further comprising a third roll of stretch film supported adjacent to the secondary roll of stretch film, and a second set of guides comprising a second guide width less than the width of the primary roll; wherein the second set of guides is positioned to receive stretch film from the third roll, narrow the stretch film from third roll to a width less than the width of the primary roll, and after narrowing the stretch film from the third roll positioning the stretch film from the third roll to overlap the stretch film from the third roll onto the primary roll stretch film between the top and bottom edges of the primary roll stretch film adjacent to the secondary roll stretch film as the primary roll stretch film, the secondary roll stretch film and the stretch film from the third roll are wrapped around a palletized load.

9. The apparatus of claim 8, further comprising a fourth roll of stretch film supported adjacent to the second roll of stretch film, and a third set of guides comprising a third guide width less than the width of the primary roll; wherein the third set of guides is positioned to receive stretch film from the fourth roll, narrow the stretch film from the fourth roll to a width less than the width of the primary roll, and after narrowing the stretch film from the fourth roll positioning the stretch film from the fourth roll to overlap the stretch film from the fourth roll onto the primary roll stretch film between the top and bottom edges of the primary roll stretch film adjacent to the stretch film from the third roll as the primary roll stretch film, the secondary roll stretch film, the stretch film from the third roll and the stretch film from the fourth roll are wrapped around a palletized load.

10. The apparatus of claim 8, wherein the second roll and the third roll are positionally coupled to a common core such that the second roll and the third roll unroll at substantially the same rate.

11. The apparatus of claim 8, wherein the second roll and the third roll are each coupled to a different core of at least two cores, the at least two cores being coupled together such that the second roll and the third roll unroll at substantially the same rate.

12. The apparatus of claim 8, wherein the second roll and the third roll are colored differently than the primary roll.

13. The apparatus of claim 7, further comprising a perforating spindle positioned adjacent the second roll of stretch film to perforate the primary roll of stretch film and the at least two secondary rolls of stretch film as the primary roll and the at least two second rolls are wrapped around the palletized load.

14. The apparatus of claim 7, wherein the second roll is colored differently than the primary roll.

* * * * *